US009610467B2

(12) United States Patent
Stelter

(10) Patent No.: US 9,610,467 B2
(45) Date of Patent: Apr. 4, 2017

(54) FIRE PUMP SYSTEM AND SYSTEM CONTROLLER

(71) Applicant: Master Control Systems, Inc., Lake Bluff, IL (US)

(72) Inventor: William Stelter, Lake Bluff, IL (US)

(73) Assignee: Master Control Systems, Inc., Lake Bluff, IL (US)

( * ) Notice: Subject to any disclaimer, the term of this patent is extended or adjusted under 35 U.S.C. 154(b) by 366 days.

(21) Appl. No.: 13/943,702

(22) Filed: Jul. 16, 2013

(65) Prior Publication Data

US 2014/0048289 A1 Feb. 20, 2014

Related U.S. Application Data

(60) Provisional application No. 61/672,011, filed on Jul. 16, 2012.

(51) Int. Cl.

| | |
|---|---|
| ***A62C 37/36*** | (2006.01) |
| ***A62C 37/00*** | (2006.01) |
| ***F04B 49/06*** | (2006.01) |

(52) U.S. Cl.

CPC ..... *A62C 37/04* (2013.01); *A62C 37/00* (2013.01); *A62C 37/36* (2013.01); *F04B 49/065* (2013.01); *F04B 2205/09* (2013.01)

(58) Field of Classification Search

CPC ..... A62C 35/605; A62C 37/04; A62C 37/36; A62C 37/38; A62C 37/40

See application file for complete search history.

(56) References Cited

U.S. PATENT DOCUMENTS

| | | | | |
|---|---|---|---|---|
| 3,544,235 | A | 12/1970 | Smith | |
| 3,974,879 | A | 8/1976 | Nelson et al. | |
| 4,611,290 | A * | 9/1986 | Henningsen et al. | 700/283 |
| 4,984,637 | A * | 1/1991 | Finnigan | 169/61 |
| 5,221,189 | A | 6/1993 | Henningsen | |
| 5,729,698 | A | 3/1998 | Stelter | |
| 6,651,900 | B1 * | 11/2003 | Yoshida | 239/72 |
| 7,762,786 | B2 | 7/2010 | Taylor et al. | |
| 8,068,026 | B1 * | 11/2011 | Delerno et al. | 340/540 |
| 2006/0272830 | A1 * | 12/2006 | Fima | 169/16 |
| 2011/0056707 | A1 * | 3/2011 | Gamble et al. | 169/14 |

* cited by examiner

*Primary Examiner* — Ryan Reis

(74) *Attorney, Agent, or Firm* — Bishop Diehl & Lee, Ltd.

(57) ABSTRACT

A fire suppression and control system includes a unique fire pump controller which uses advanced technologies in a manner consistent with the need for high reliability in the fire protection industry. A preferred controller includes three PIC chips including a control PIC for controlling operation of the water pump, a power monitor PIC for receiving all voltage and current inputs to the controller, and a data recorder PIC for collection and storage of data relevant to the system. The controller may also include an electronically coupled HMI which queries the controller for information to display, wherein the HMI does not pass information between components of the controller and is capable of being damaged without stopping or preventing operation of the controller, and an isolation scheme for isolating the controller from incoming energy transients, such as lightning, the isolation scheme comprising a relay and opto-isolators to drive the relay and increase the isolation by a factor of at least two over the relay alone.

19 Claims, 33 Drawing Sheets

FIRE PUMP SYSTEM AND SYSTEM CONTROLLER

CROSS-REFERENCE TO RELATED APPLICATIONS

This application claims the benefit of U.S. Provisional Patent Application Ser. No. 61/672,011 filed on Jul. 16, 2012.

TECHNICAL FIELD OF THE INVENTION

The disclosed systems and methods relate to fire control and suppression in a building structure, such as a manufacturing plant, school, office building, and the like, as well as a pump controller for such a system. More particularly, the systems and methods relate to a controller having and using high-reliability techniques to give assurance that the system will operate when needed.

BACKGROUND OF THE INVENTION

Fire pump control systems are commonly used in large buildings to control the flow of water to sprinkler heads as part of a fire suppression system. Generally speaking, a fire pump control system operates a connected water pump system for directing high-pressure water to sprinkler heads situated throughout a building.

To do this, a typical pump control system is also connected and responsive to any number of fire sprinkler heads and sensors positioned within building areas to be protected. The control system activates the water pump upon detection of a low fire water pressure to supply water to the heads in the specific protected area. The control system is designed to control and monitor all aspects of the fire water pump system, including water pressure, flow rate, as well as the starting and stopping of the water pump.

Initially and periodically, the system setup and display information about the fire pump controller must be input (i.e., operation parameters) using an electrical input interface. However, these and other electrical components may be unreliable and prone to failure, which can lead to catastrophic consequences in the event of a fire. This is a substantial problem with prior art pump control systems.

Various fire pump control systems have been developed to supply water under pressure to a fire suppression system. Examples of such systems are disclosed in U.S. Pat. No. 3,974,879 and U.S. Pat. No. 3,544,235 which are hereby incorporated by reference in their entirety. Further, U.S. Pat. Nos. 5,221,189, 5,729,698 and 7,762,786 are also incorporated by reference in their entirety. These systems have been generally effective for their intended purpose but do not overcome all of the limitations and deficiencies of prior systems. Accordingly, there is a continuing need in the industry for a more reliable fire pump control system.

Until the invention of the present application, these and other problems in the prior art went either unnoticed or unsolved by those skilled in the art. The present invention provides a fire control system which will operate more reliably without sacrificing features, designs, style or affordability.

SUMMARY OF THE INVENTION

The fire pump control system is for fire suppression in a building or structure and is generally comprised of a water delivery system, including a controller, pump driver, water pipes, connectors, sensors and sprinkler heads.

The various embodiments of the controller are each electronically coupled to a water pump driver and comprises at least one of either (a) three isolated chips, including a control PIC for controlling operation of the water pump, a power monitor PIC for receiving all voltage and current inputs to the controller, and a data recorder PIC for collection and storage of data relevant to the system, (b) an electronically coupled HMI which queries the controller for information to display, wherein the HMI does not pass information between components of the controller and is capable of being damaged without stopping or preventing operation of the controller, and (c) an isolation scheme for isolating the controller from incoming energy transients, such as lightning, the isolation scheme comprising a relay and opto-isolators to drive the relay and increase the isolation by a factor of at least two over the relay alone.

These and other features of the inventive system and controller will be more readily apparent from a review of the following description and the appended drawings.

BRIEF DESCRIPTION OF THE DRAWINGS

For the purpose of facilitating an understanding of the subject matter sought to be protected, there are illustrated in the accompanying drawings, embodiments thereof, from an inspection of which, when considered in connection with the following description, the subject matter sought to be protected, its construction and operation, and many of its advantages should be readily understood and appreciated.

DETAILED DESCRIPTION OF THE INVENTION

Figure 1:
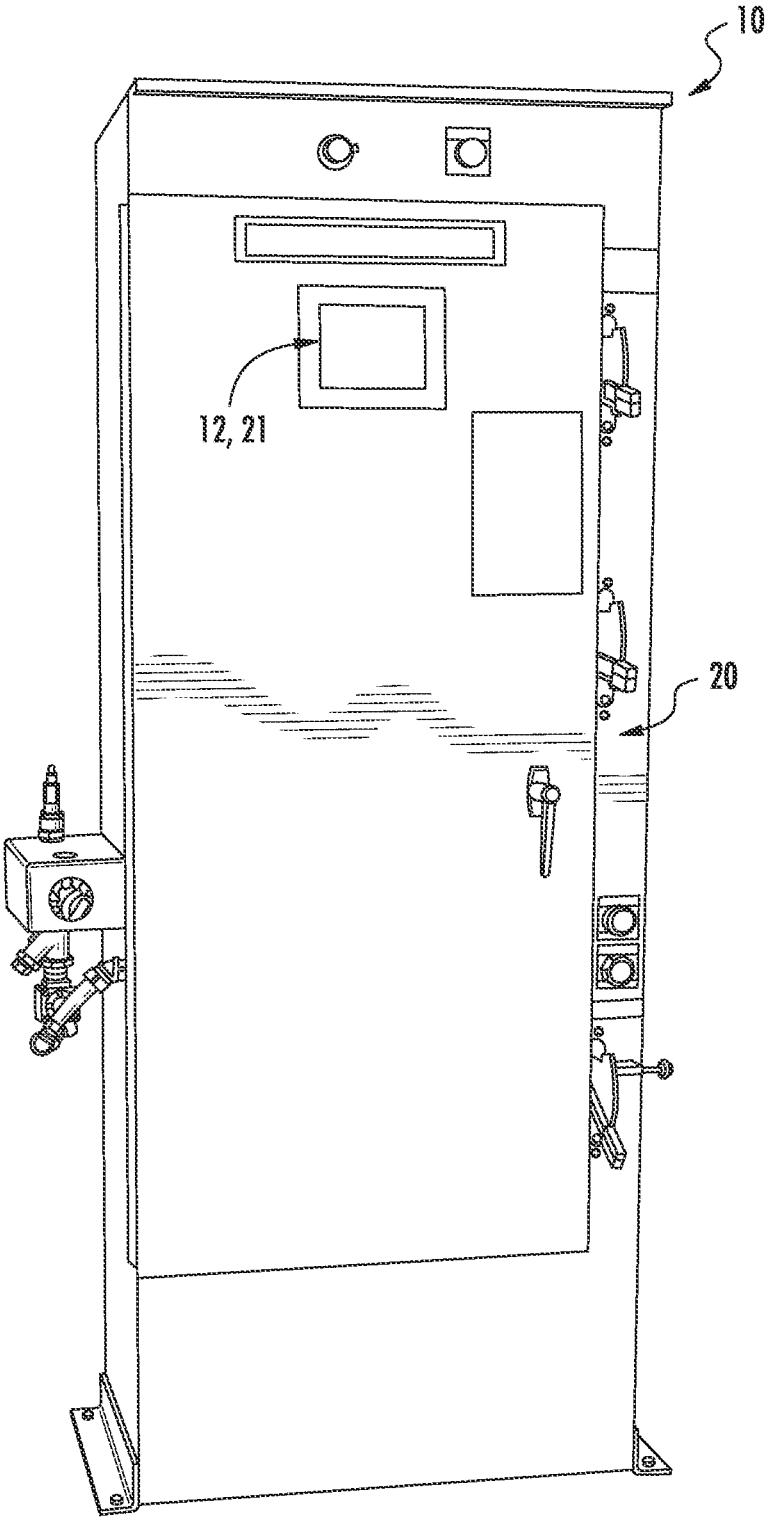
FIG. 1 illustrates an embodiment of a cabinet for a fire pump controller in accordance with the present disclosure.

While this invention is susceptible of embodiments in many different forms, there is shown in the drawings and appendix, and will herein be described in detail, at least one preferred embodiment of the invention with the understanding that the present disclosure is to be considered as an exemplification of the principles of the invention and is not intended to limit the broad aspect of the invention to any of the specific embodiments illustrated.

Referring to FIGS. 1-4, there is illustrated a fire protection/suppression system 100 and a fire pump controller, generally designated by the numeral 10. The particular illustrated controller 10 includes an outer cabinet 20, internal electronics protected by the cabinet 20, an operational display 21 in the door of the cabinet 20, and is for a large hi-rise building having a water supply 102 for a fire suppression/protection system 100. The fire protection system includes a system of water lines 104, connectors 106 and sprinkler heads 108, as well as a power line to bring power to operate the controller and pressure sensor 109 for detecting water pressure in the water lines. However, it should be understood that the principles of the invention can be more broadly applied to other fire protection configurations, as well as other types of buildings and structures, such as schools, campuses, malls, stores, factories and the like, as long as fire submission is a concern. The controller 10 used advanced technologies in a manner consistent with the need for high-reliability in the fire protection industry. These techniques are based on decades of experience in the design of fire protection products and are considered to be beyond the normal functional requirements of a controller.

As can be seen in the referenced FIGS. 1-4, the controller 10 is comprised of a cabinet 20 having an operable door 22 and housing the electronic components of the system 100. The requisite dials, gauges, buttons and switches are provided for on the cabinet as well.

Figure 2:
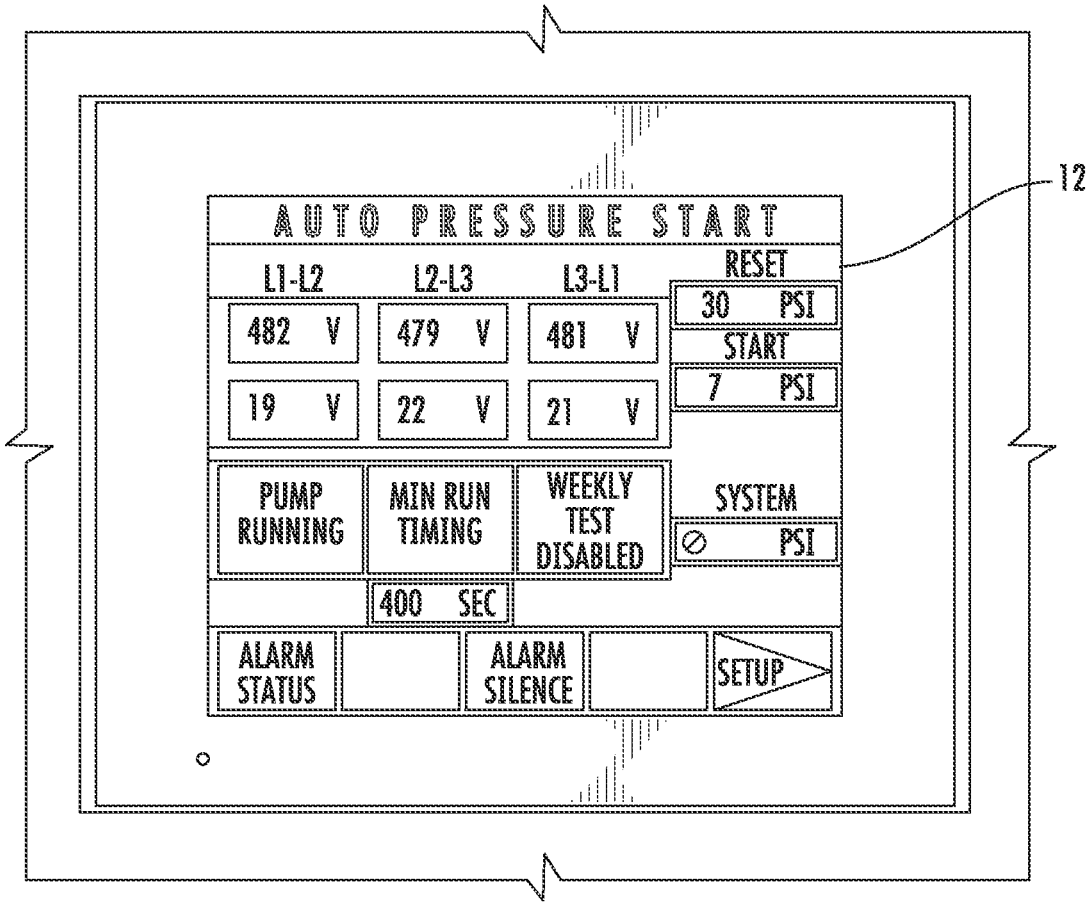
FIG. 2 illustrates an embodiment of an HMI display used in the embodiment of FIG. 1.
Figure 3:
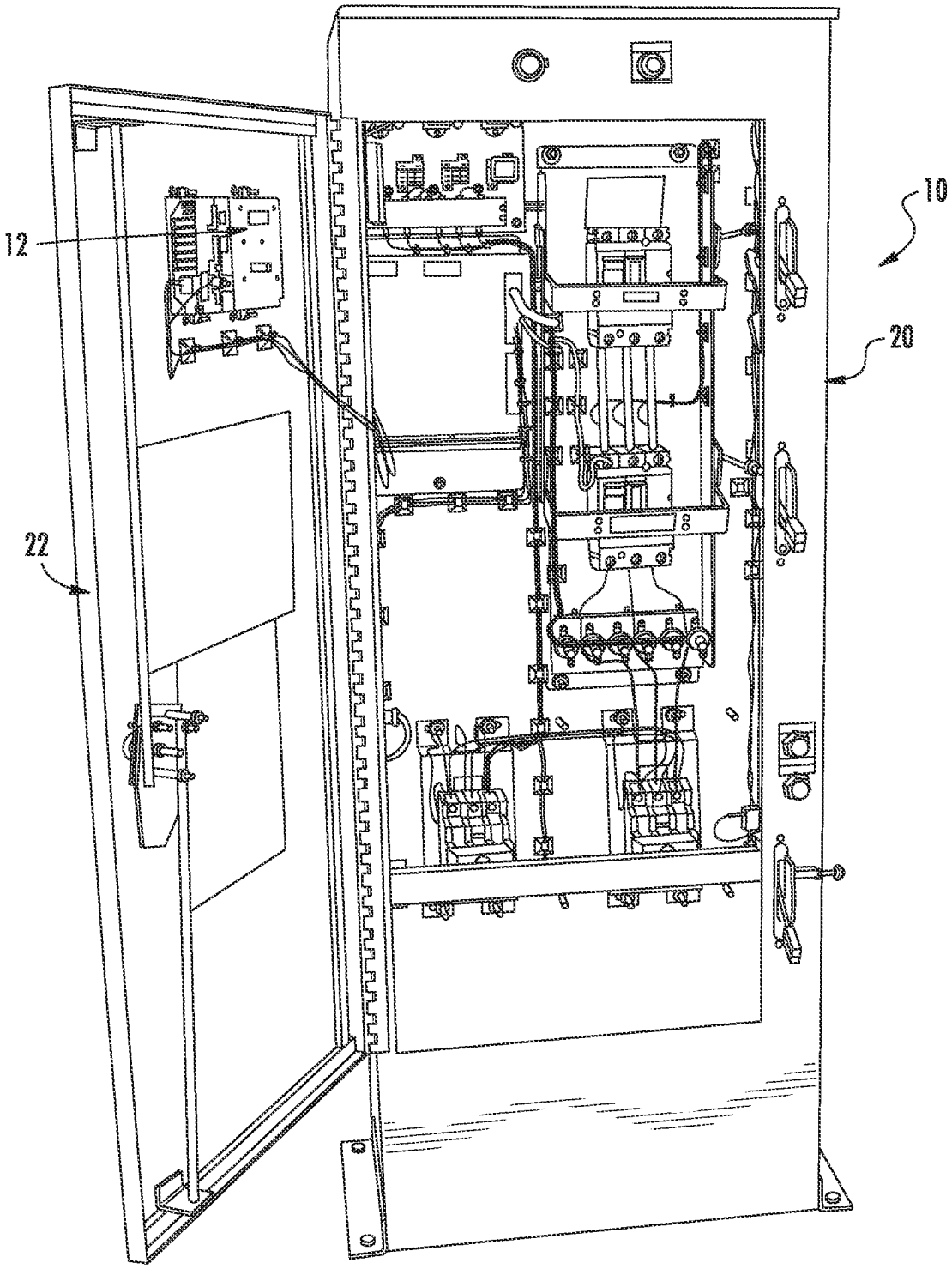
FIG. 3 illustrates the electronic components of the controller illustrated in FIG. 1.
Figure 5:
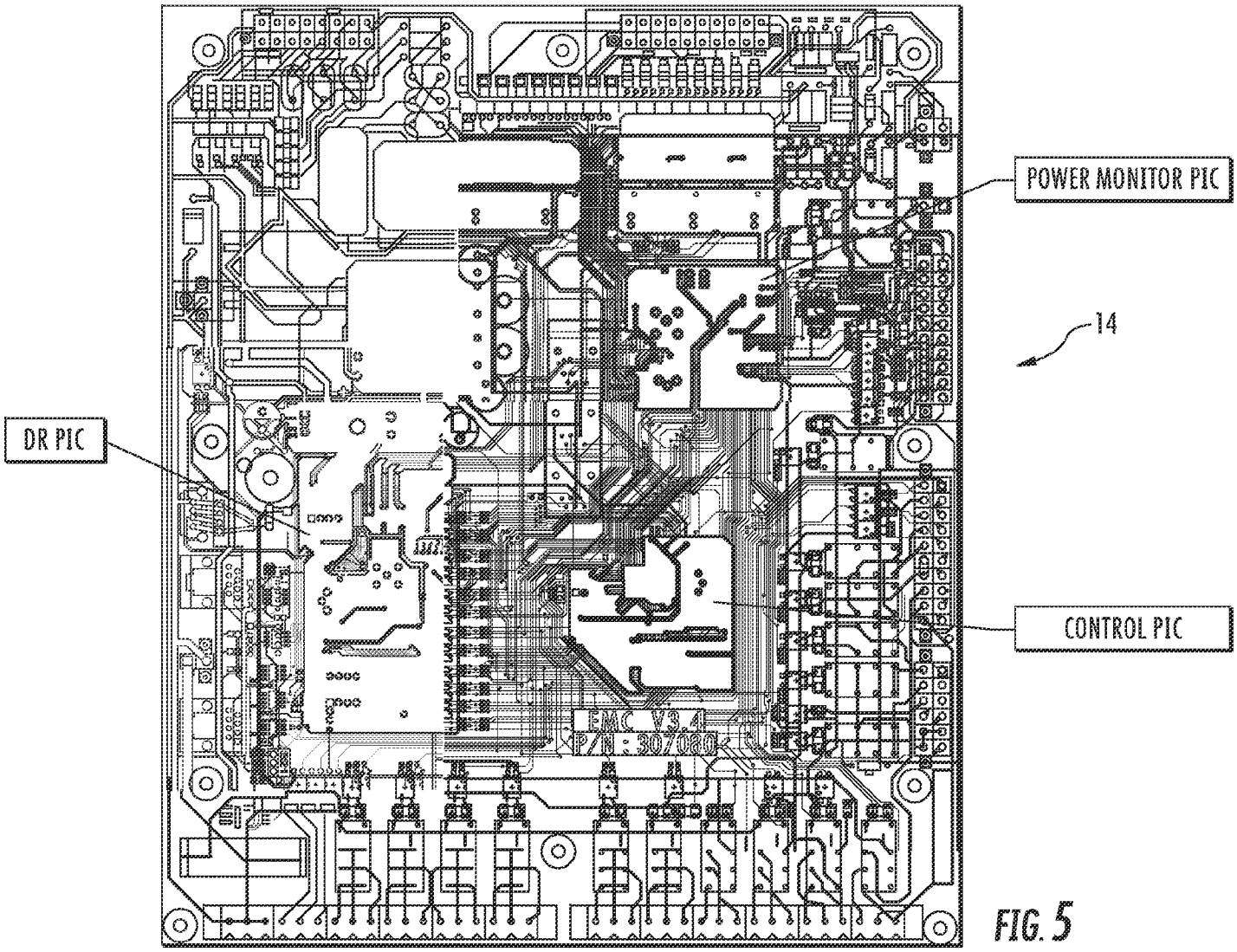
FIGS. 5-8 are electrical schematics of a control board and three Peripheral Interface Control (PIC) chips.
Figure 6:
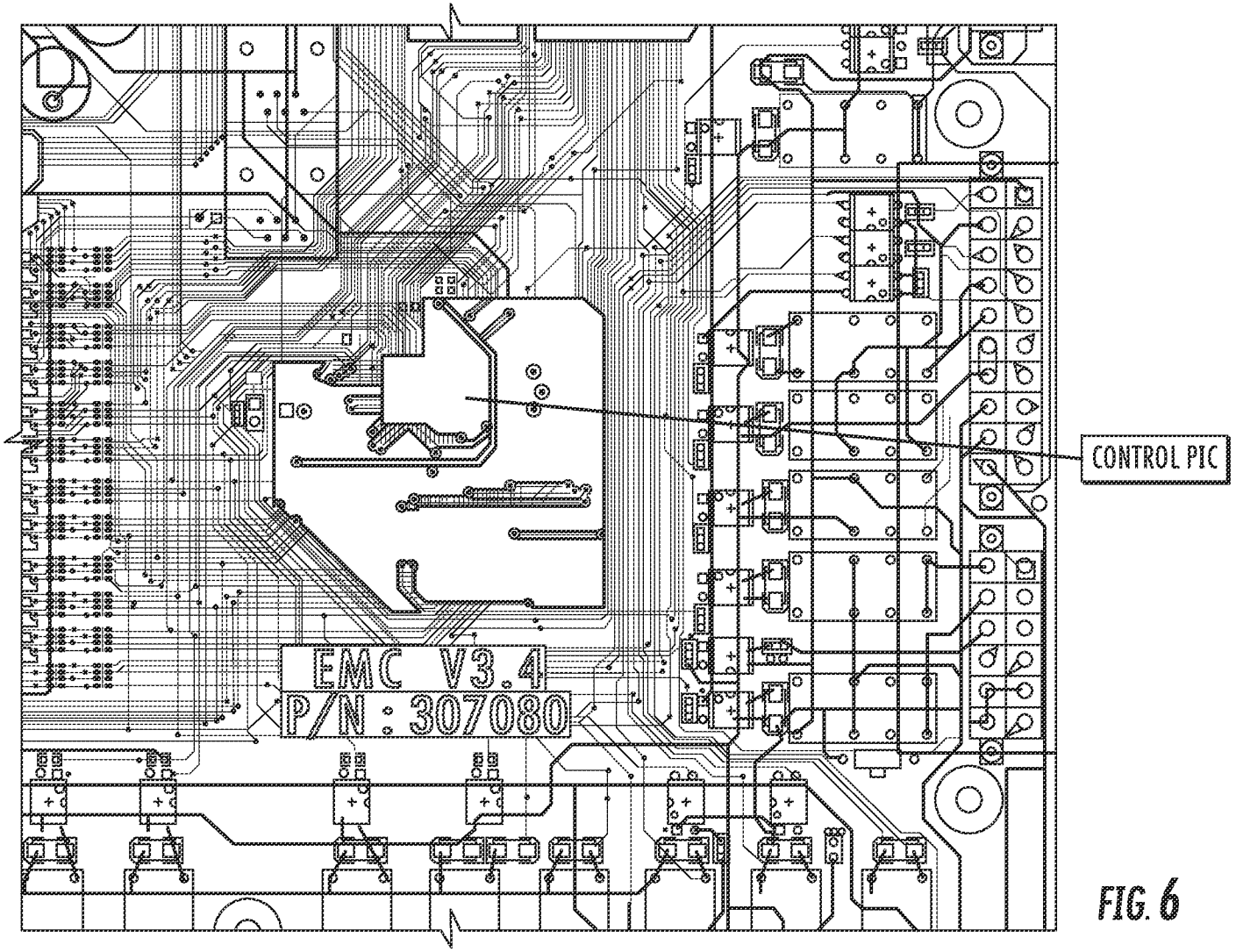
Figure 7:
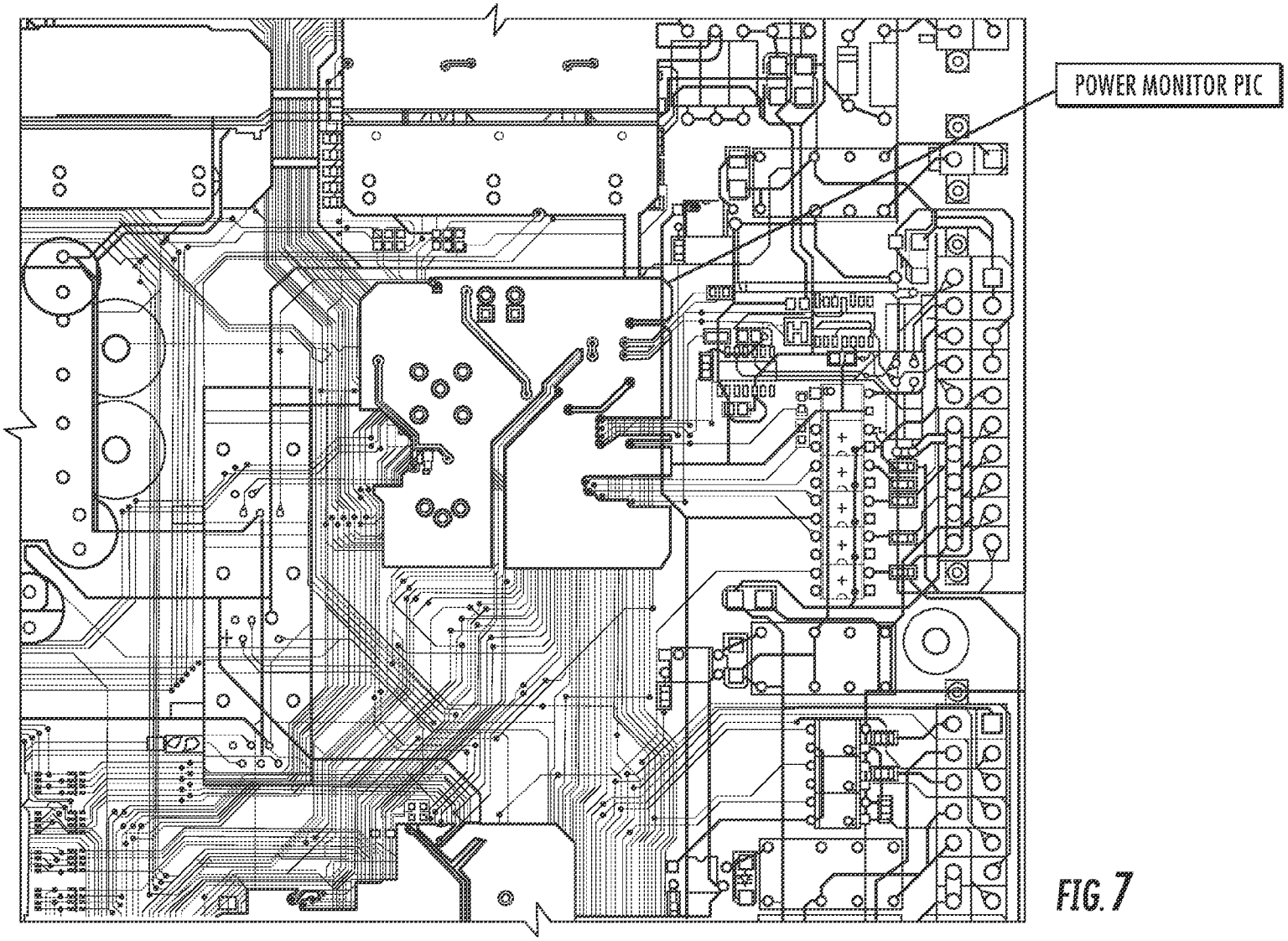
Figure 8:
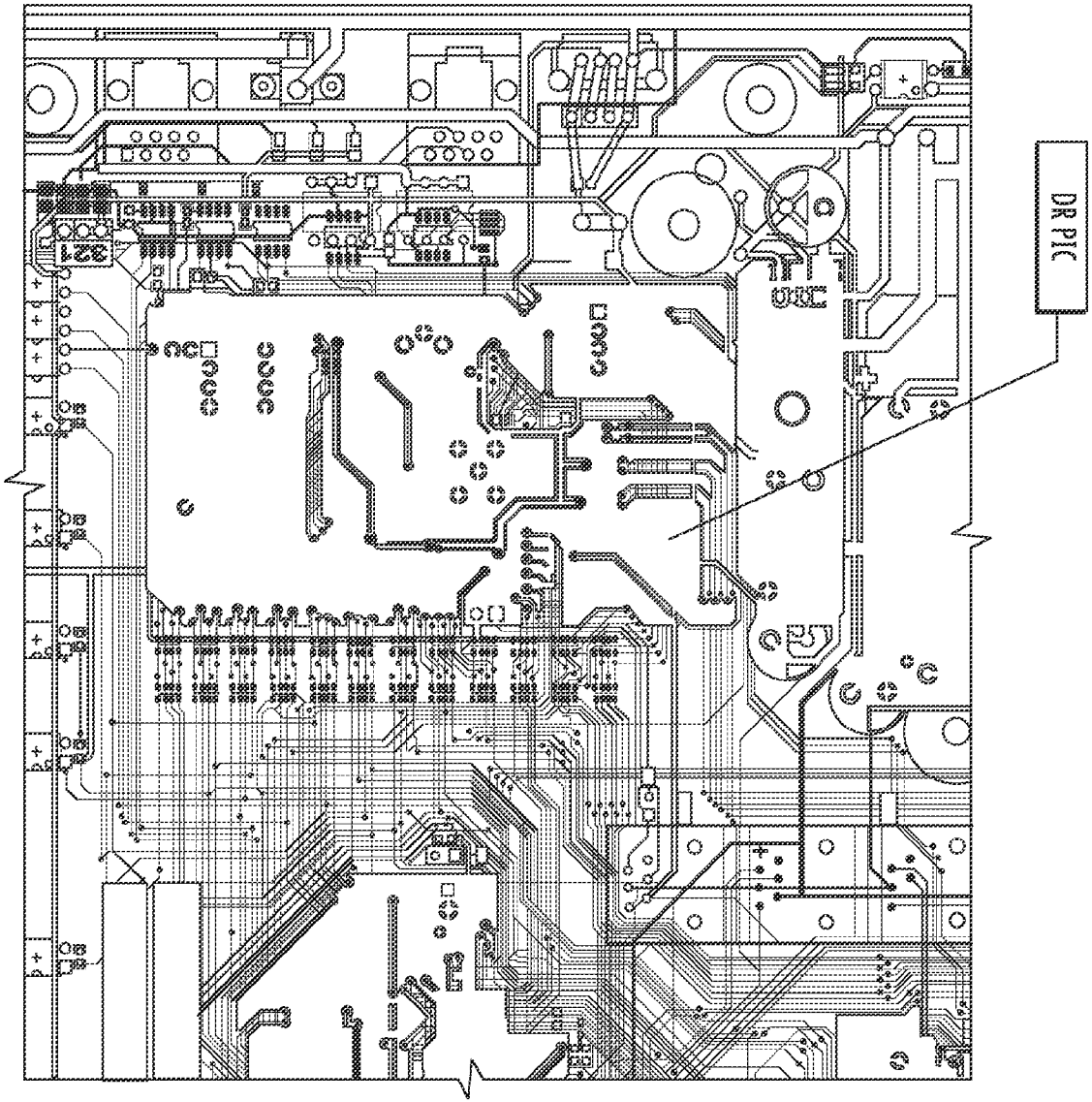
Figure 9:
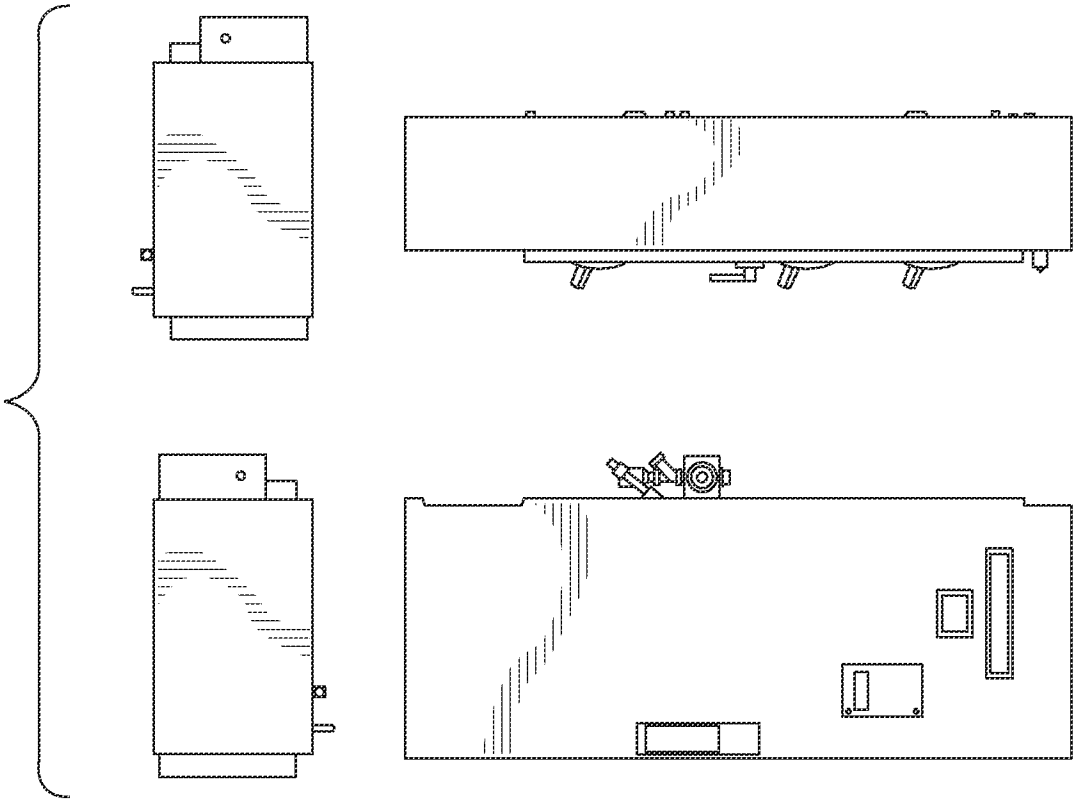
FIG. 9 is a dimensional drawing of a cabinet similar to the cabinet illustrated in FIG. 1.
Figure 10:
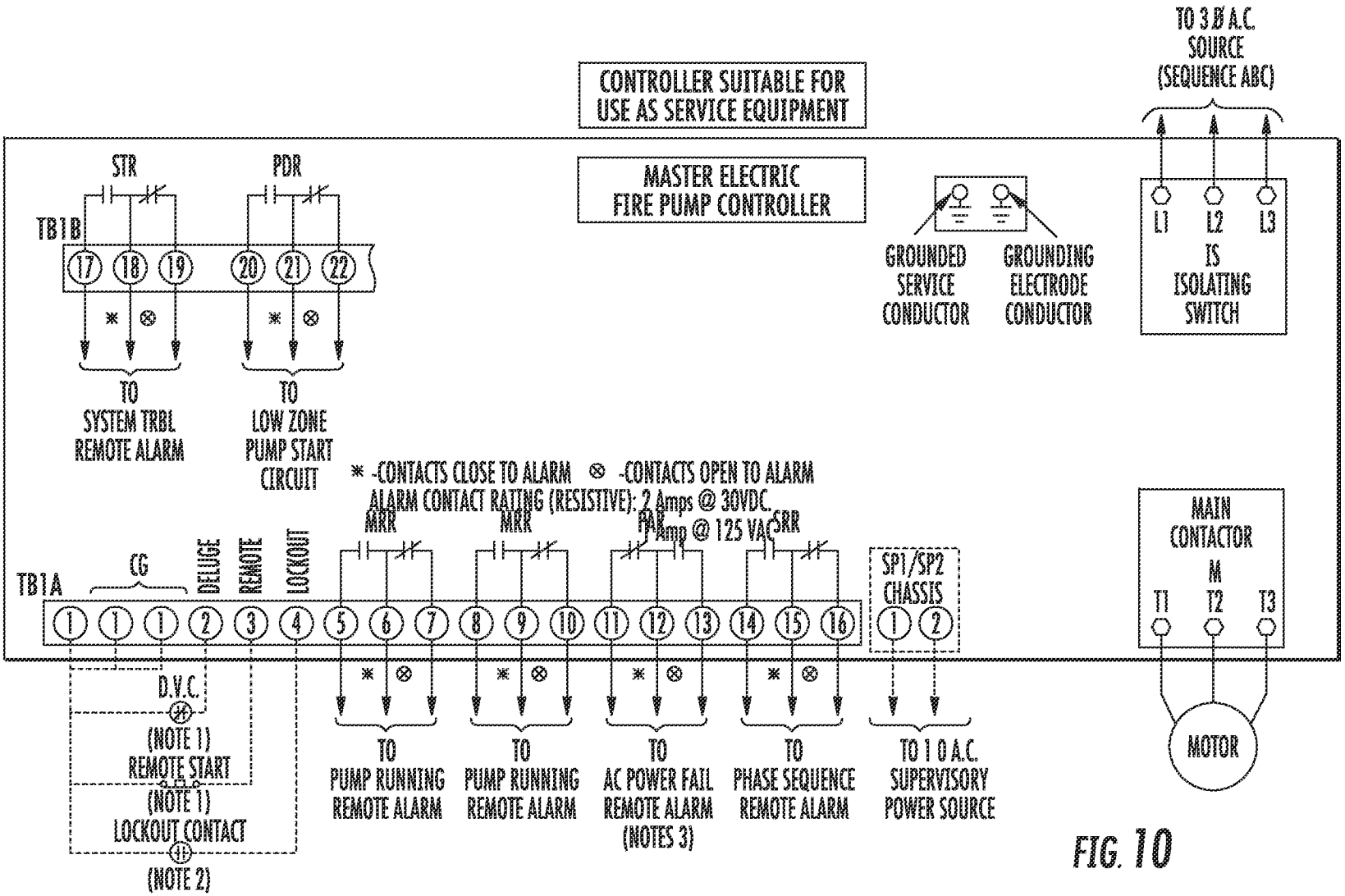
FIGS. 10-22 are electrical schematics for embodiments of the controller.
Figure 11:
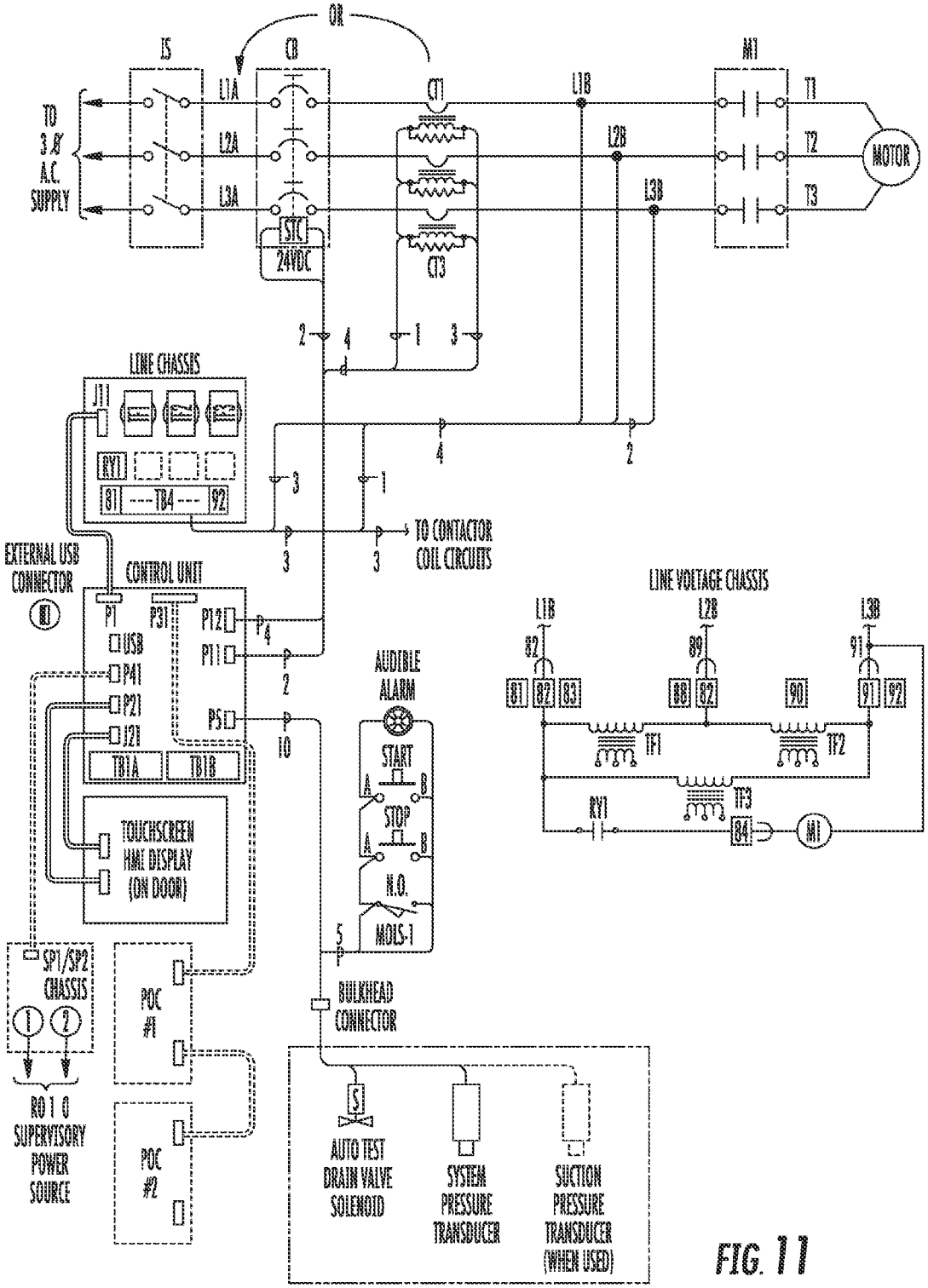
Figure 12:
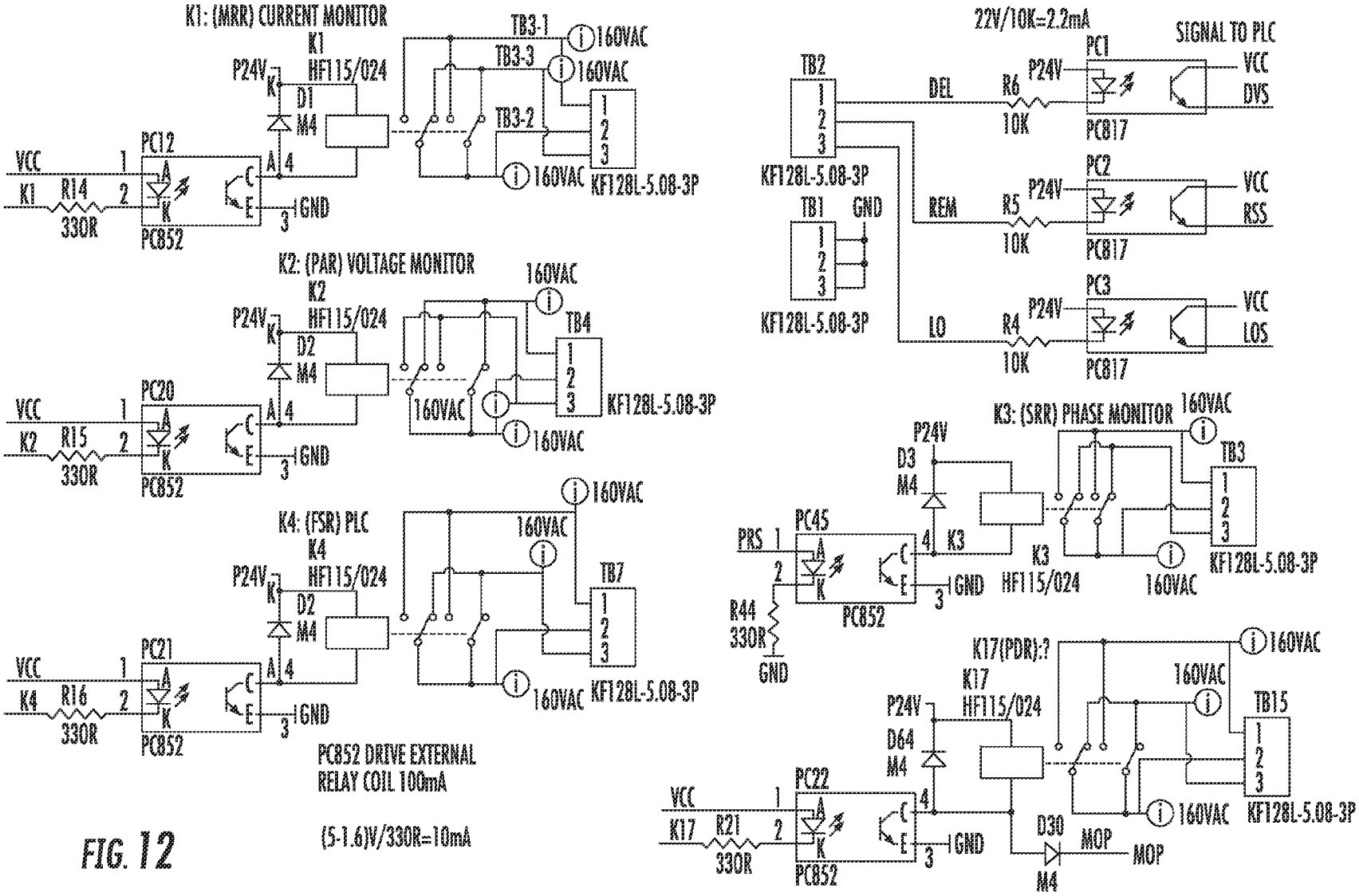
Figure 13:
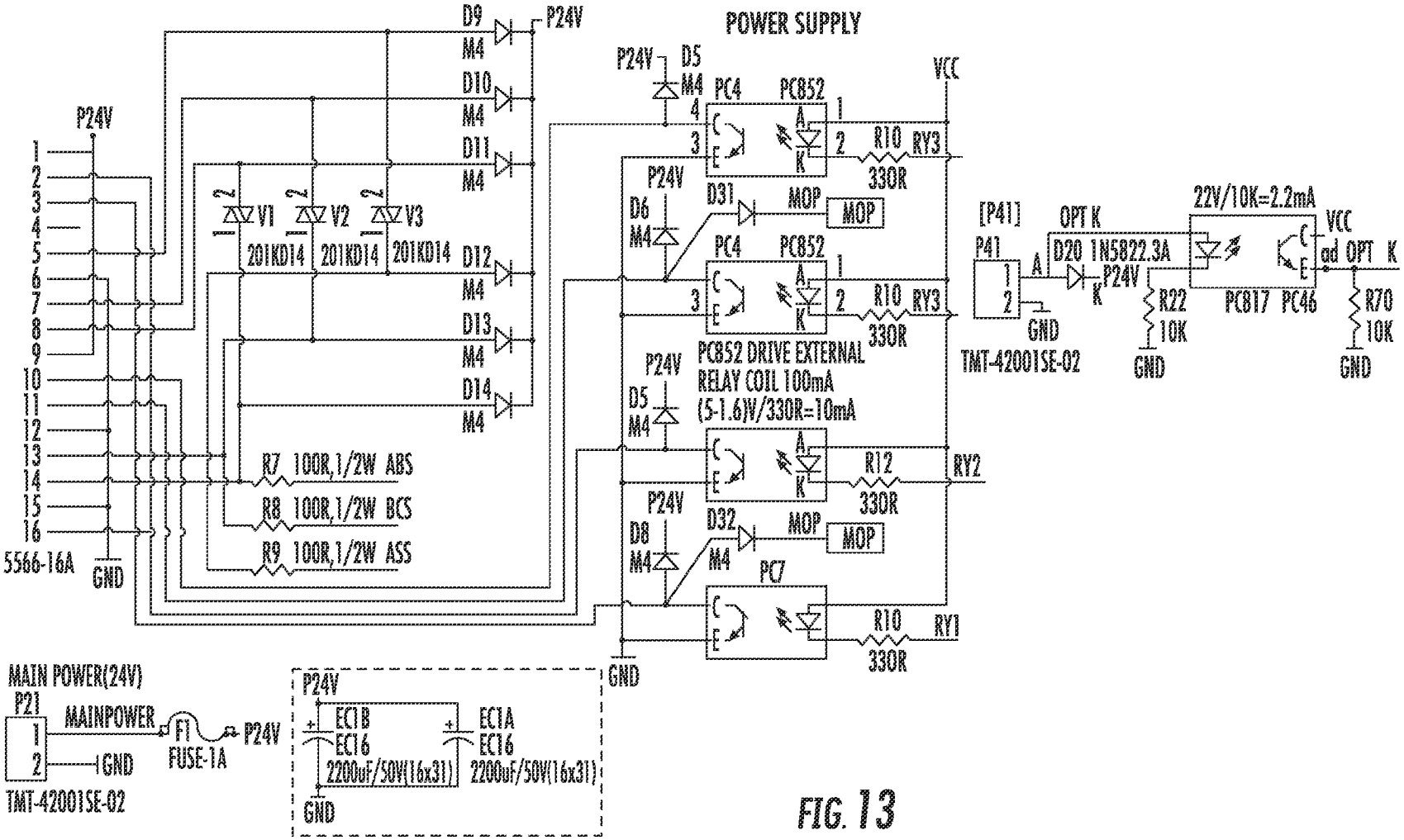
Figure 14:
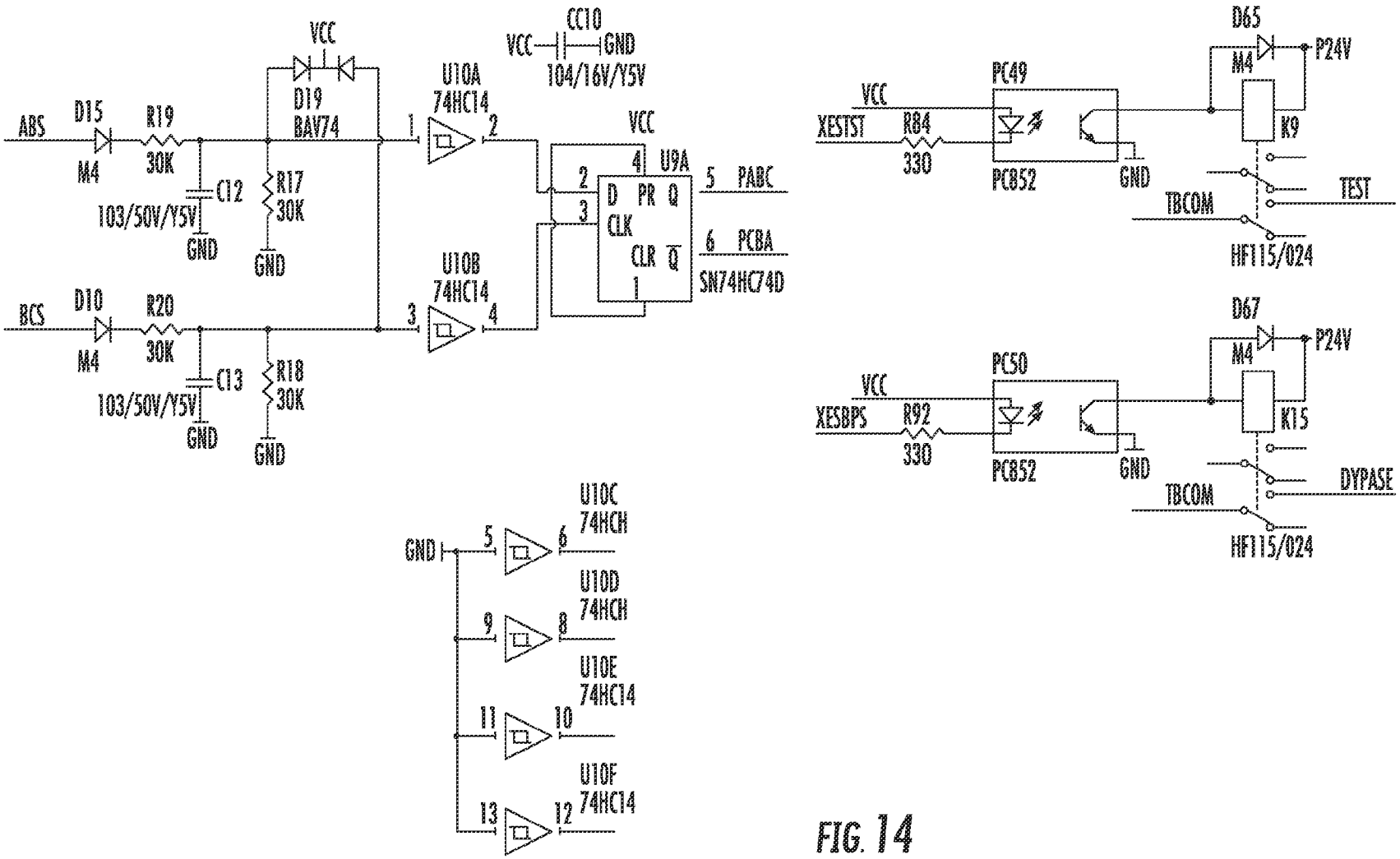
Figure 15:
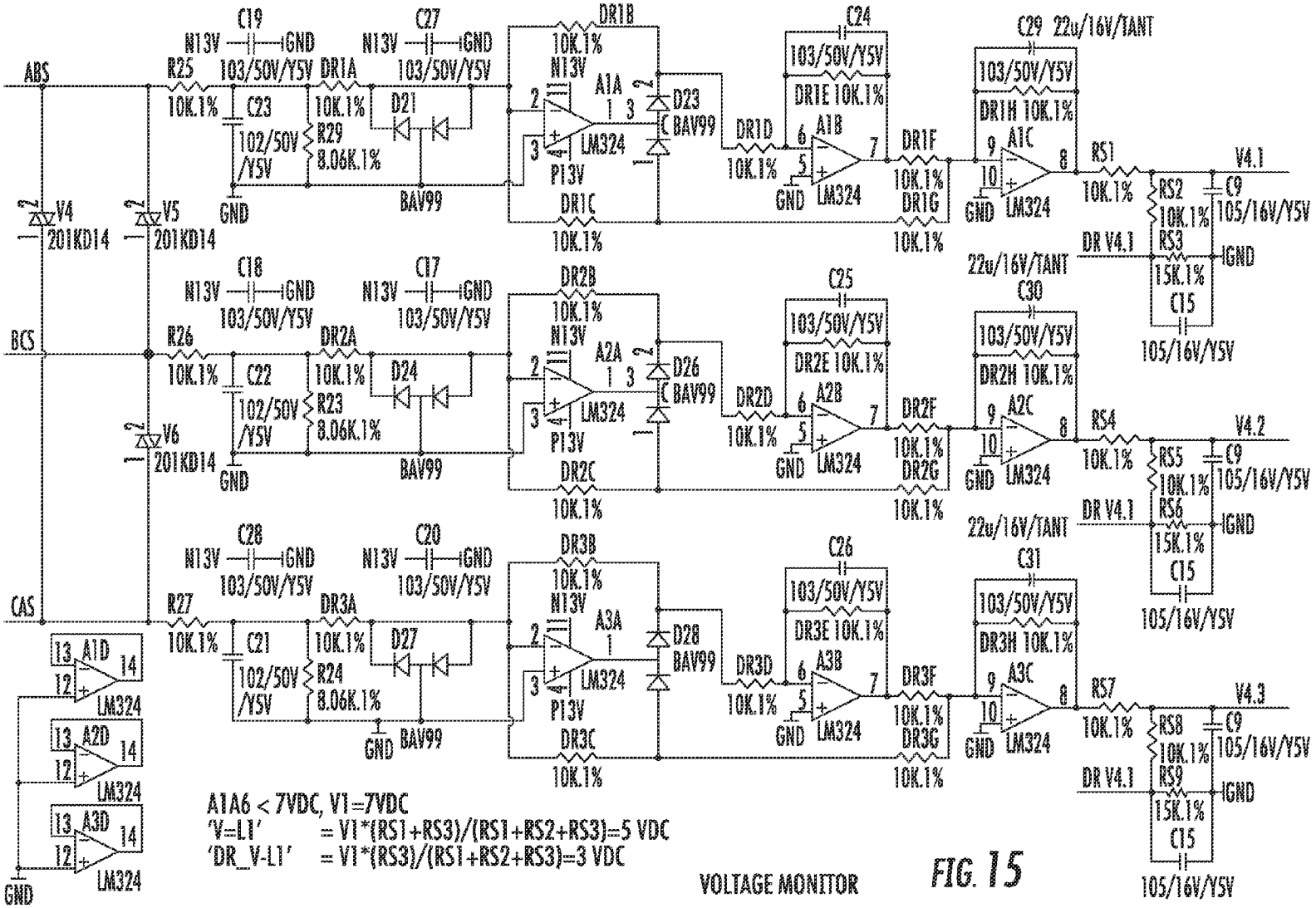
Figure 16:
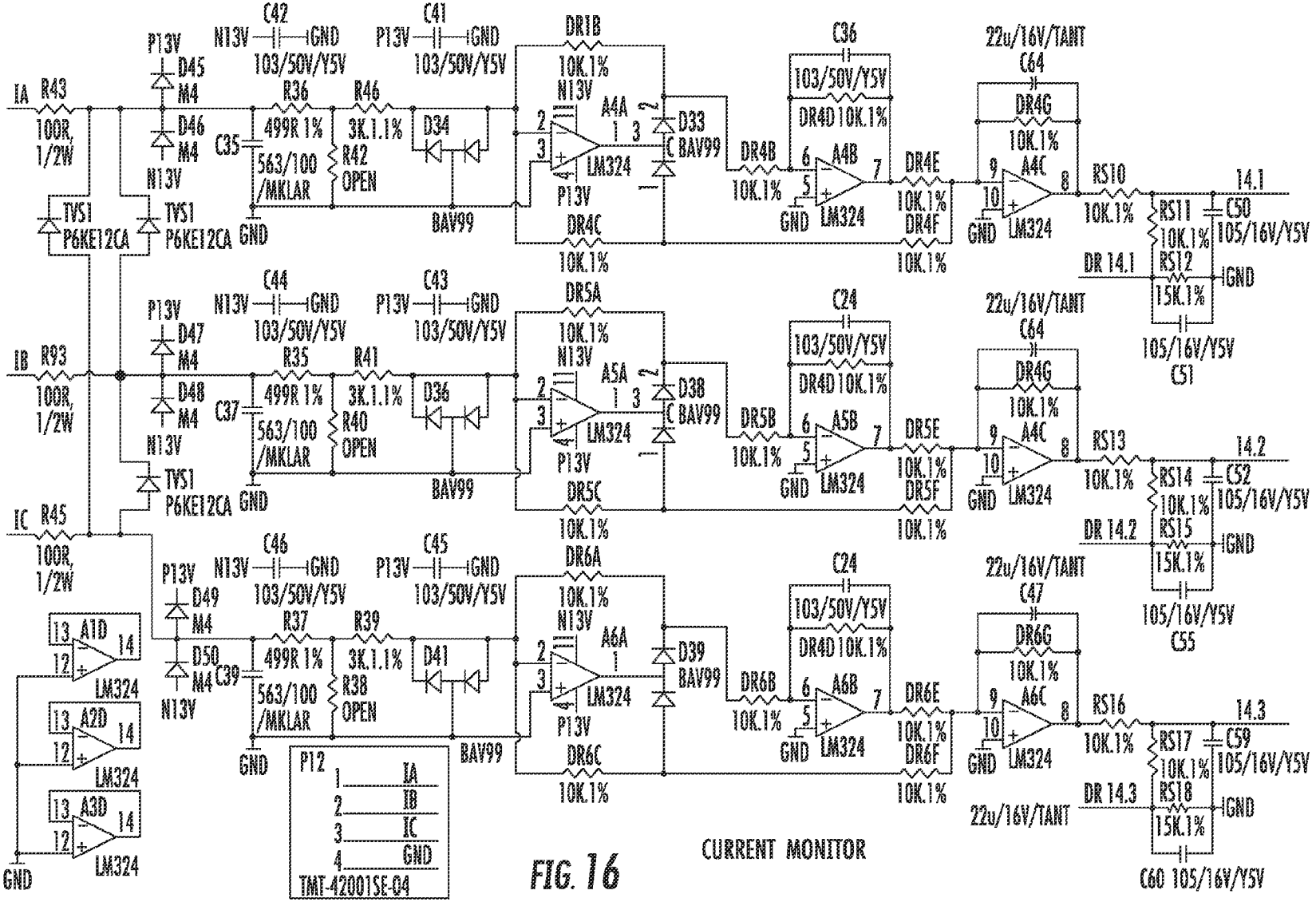
Figure 17A:
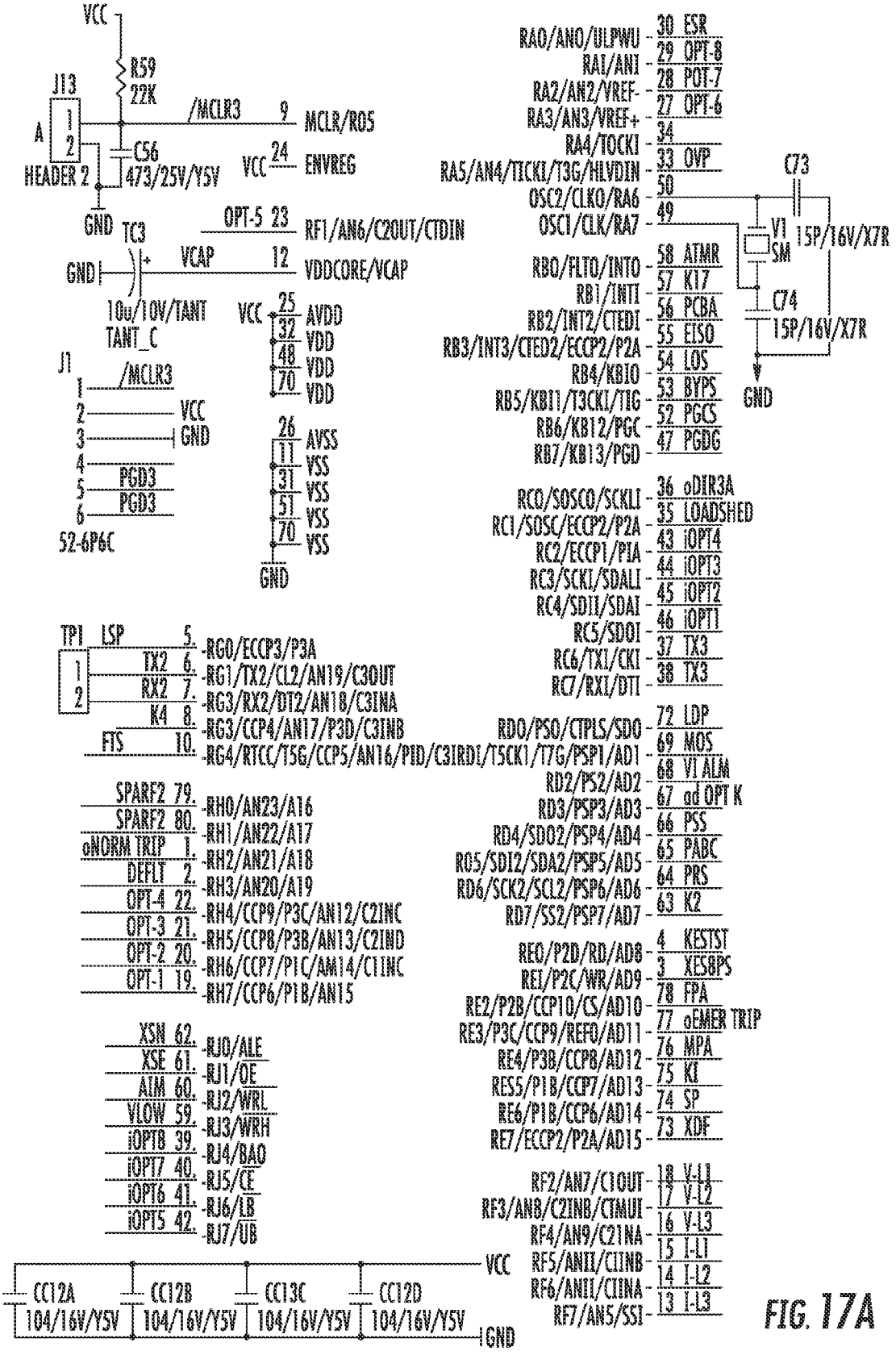
Figure 17B:
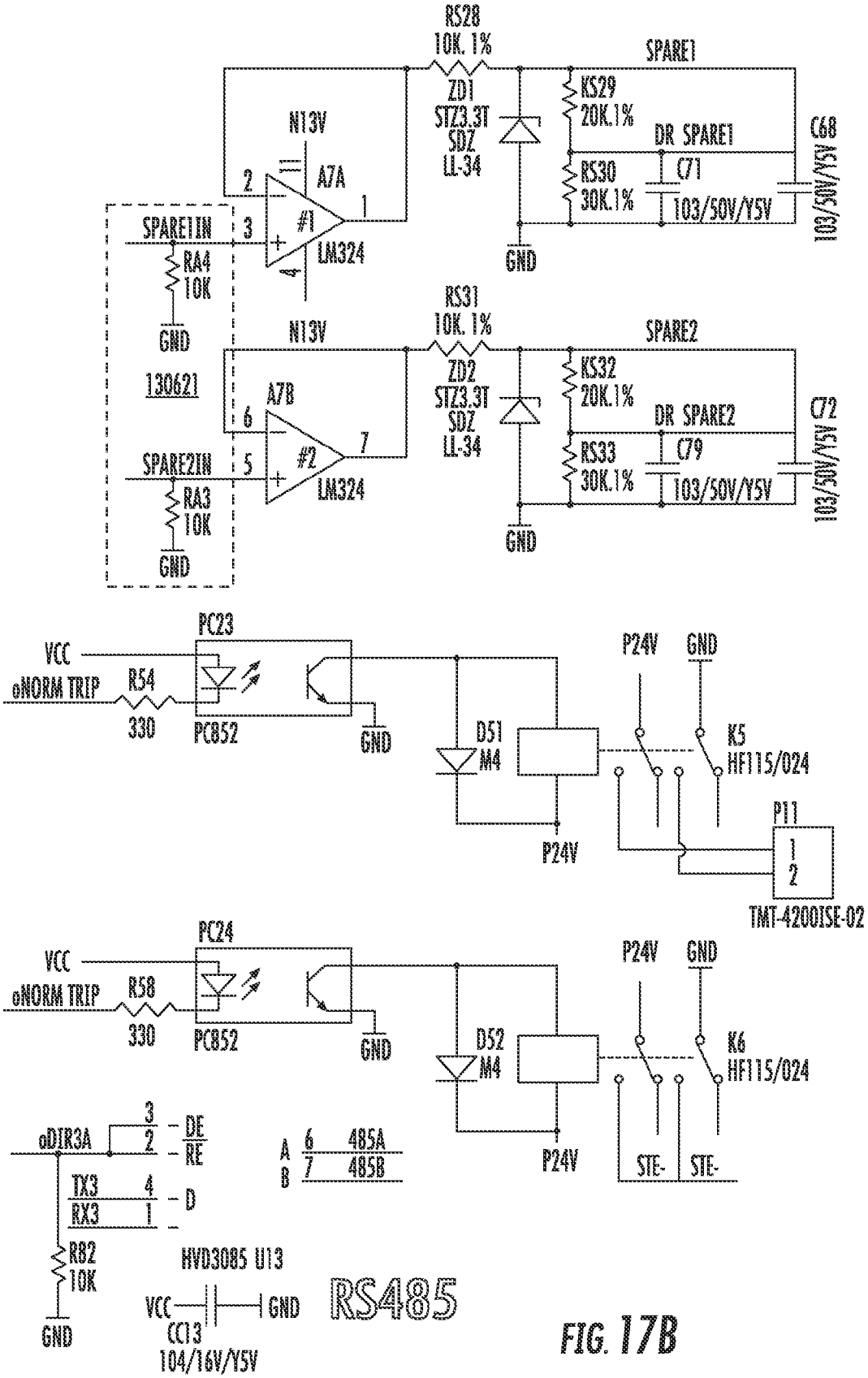
Figure 18A:
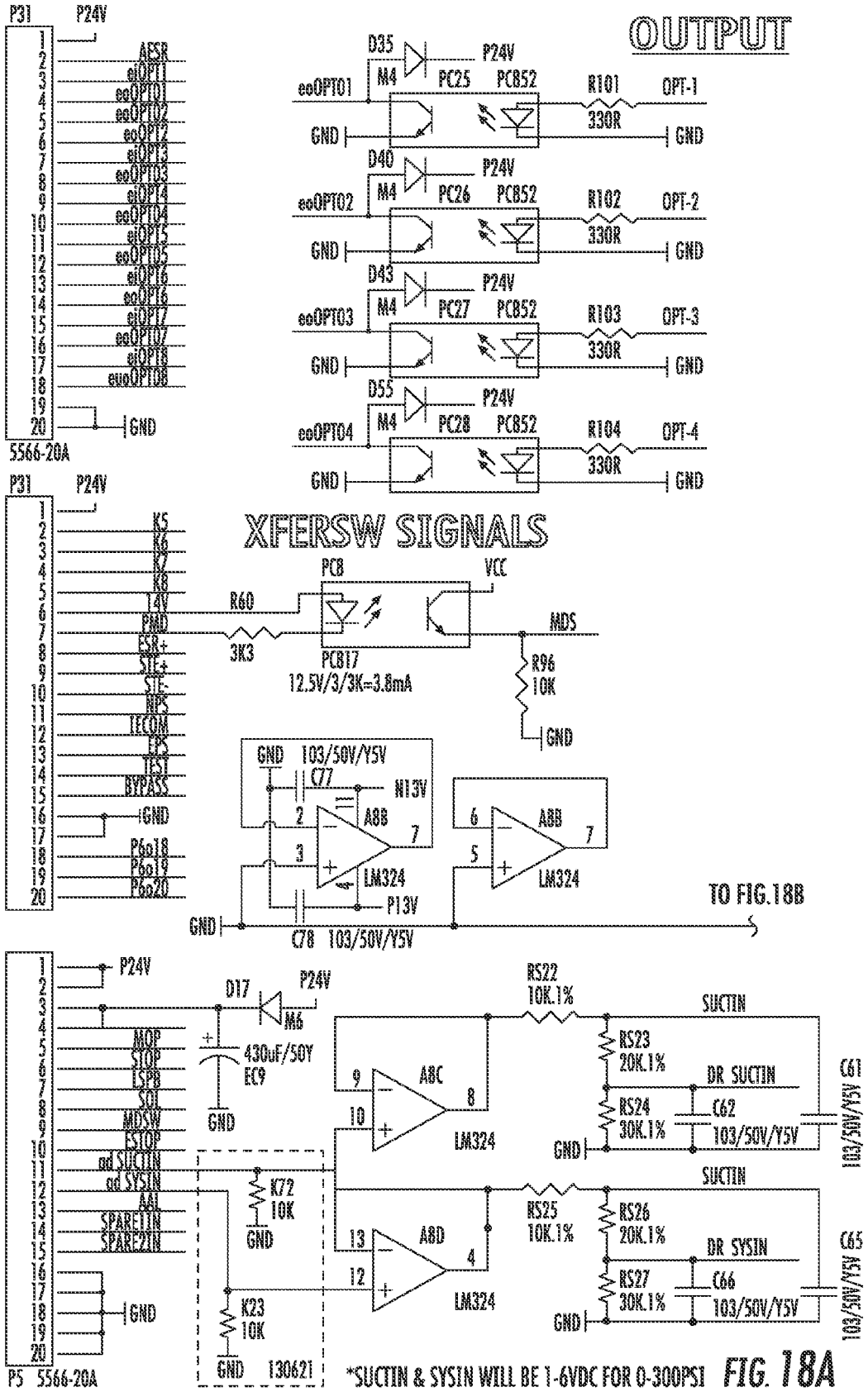
Figure 18B:
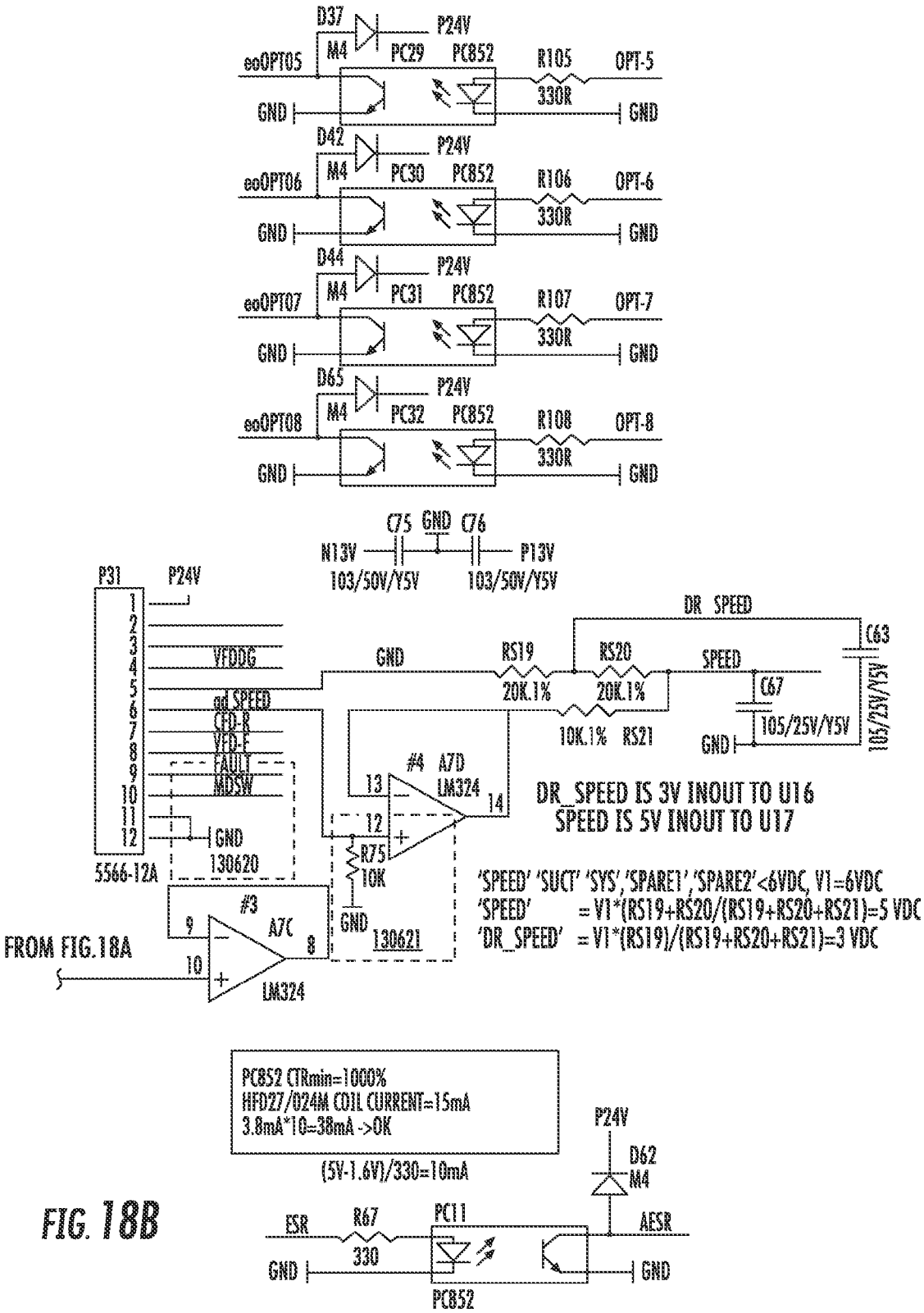
Figure 18C:
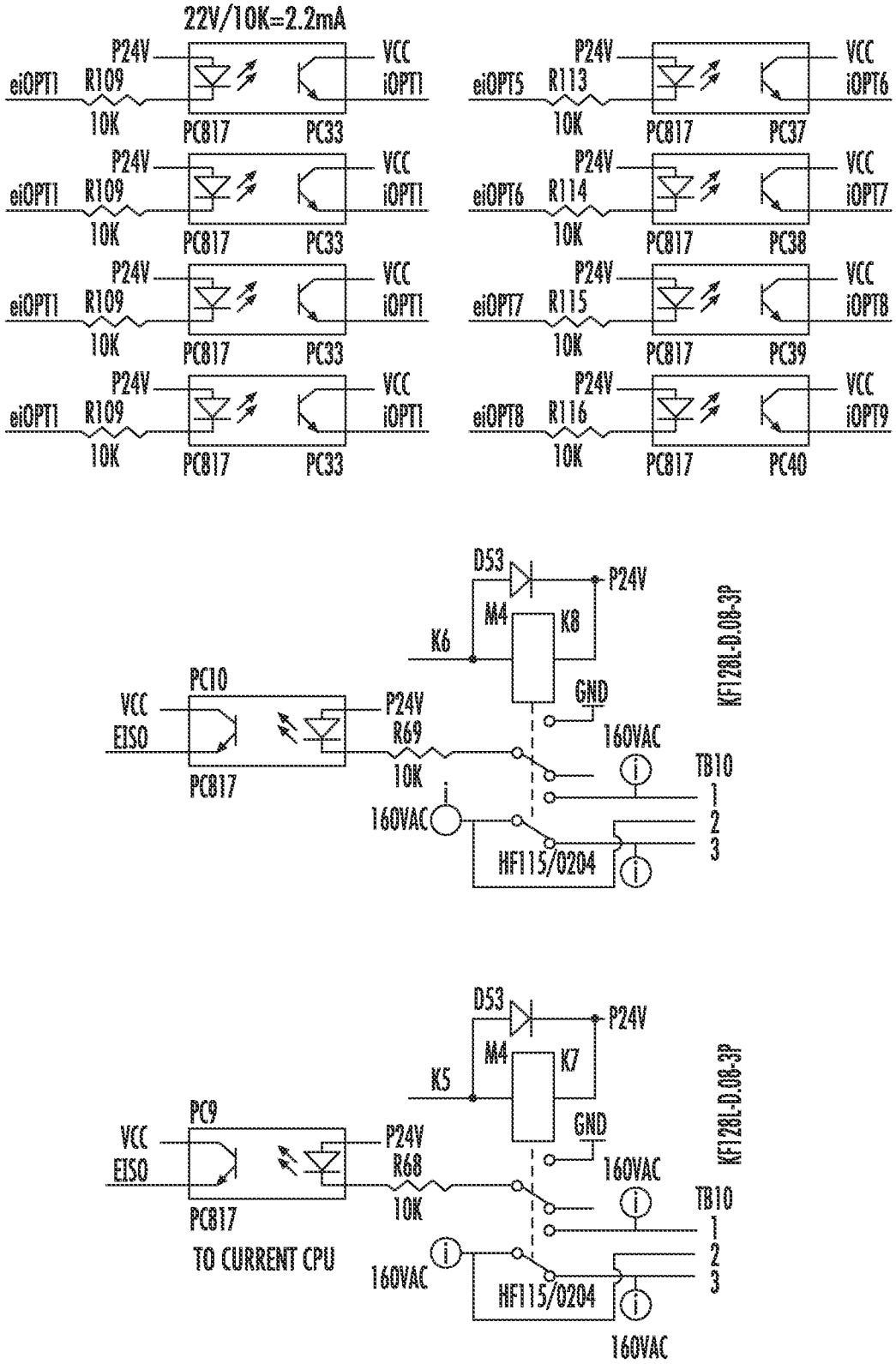
Figure 19A:
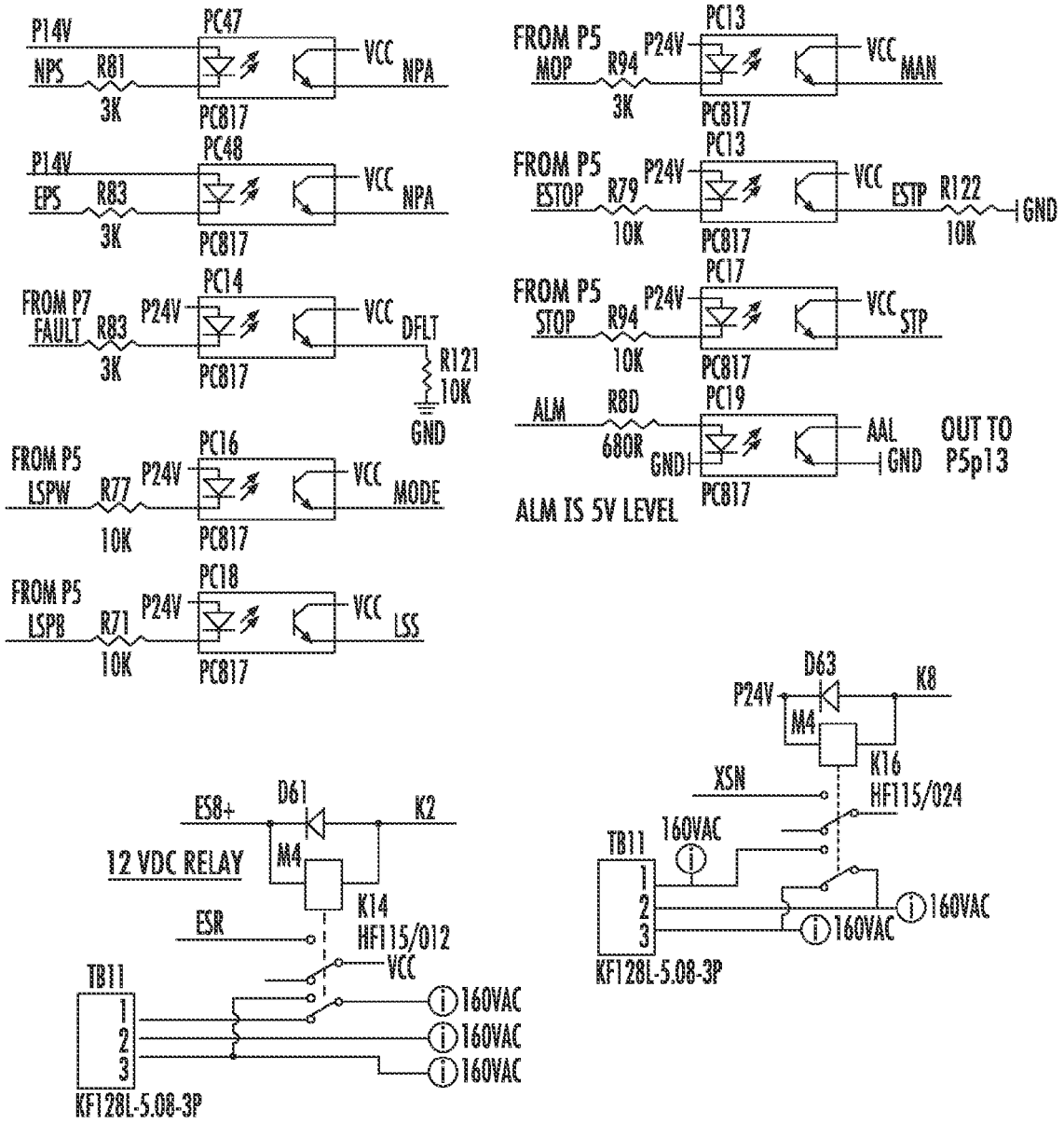
Figure 19B:
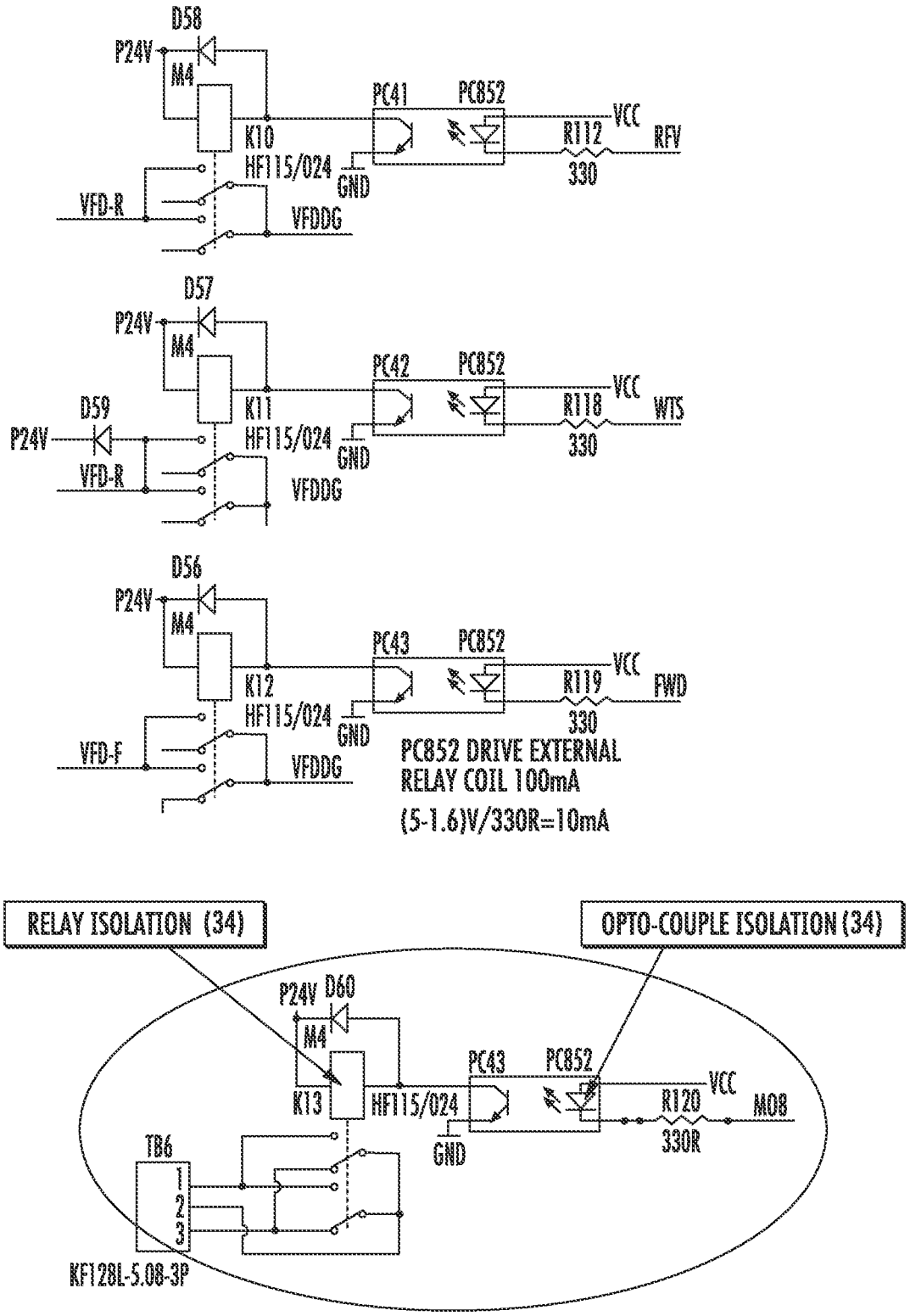
Figure 20A:
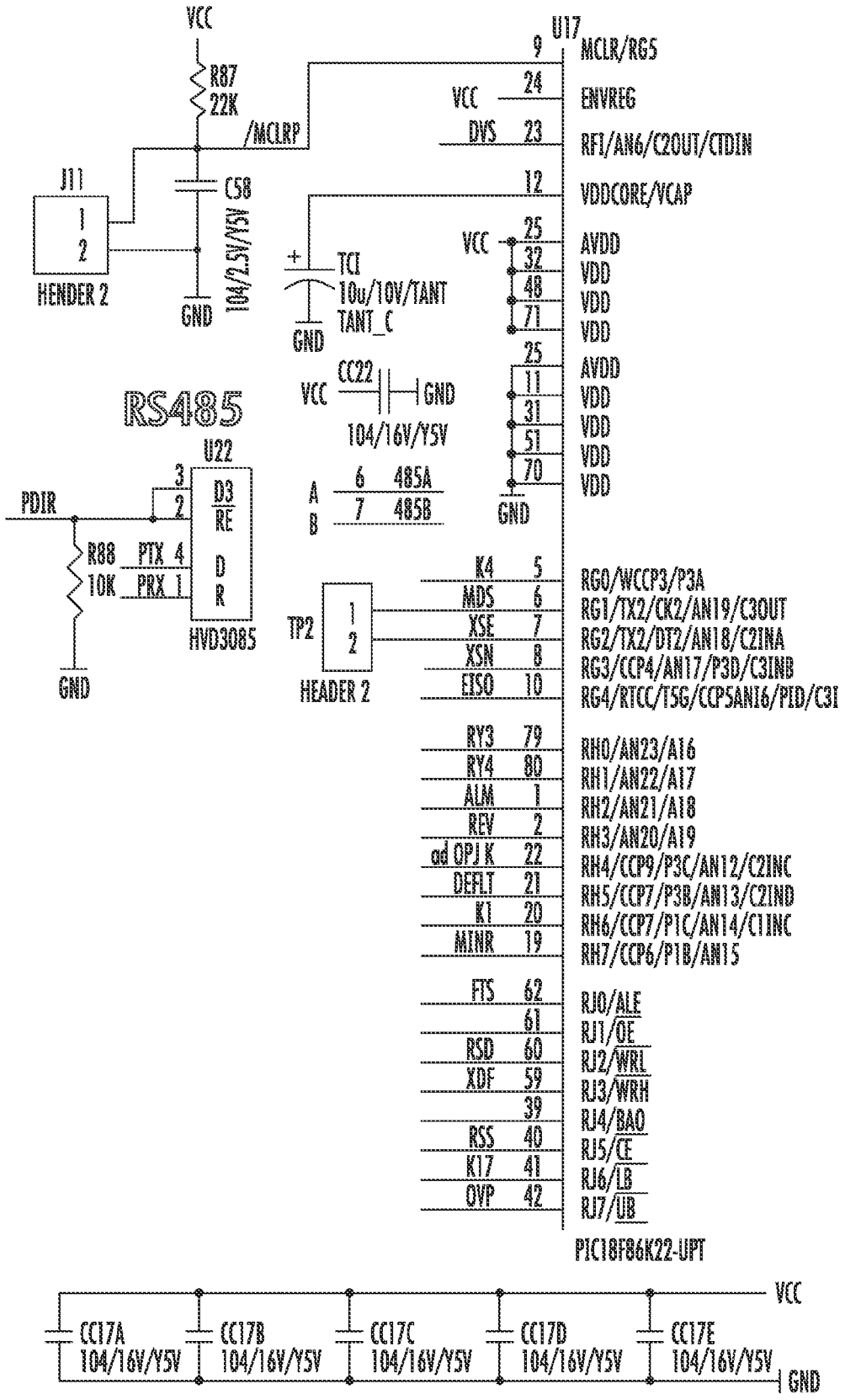
Figure 20B:
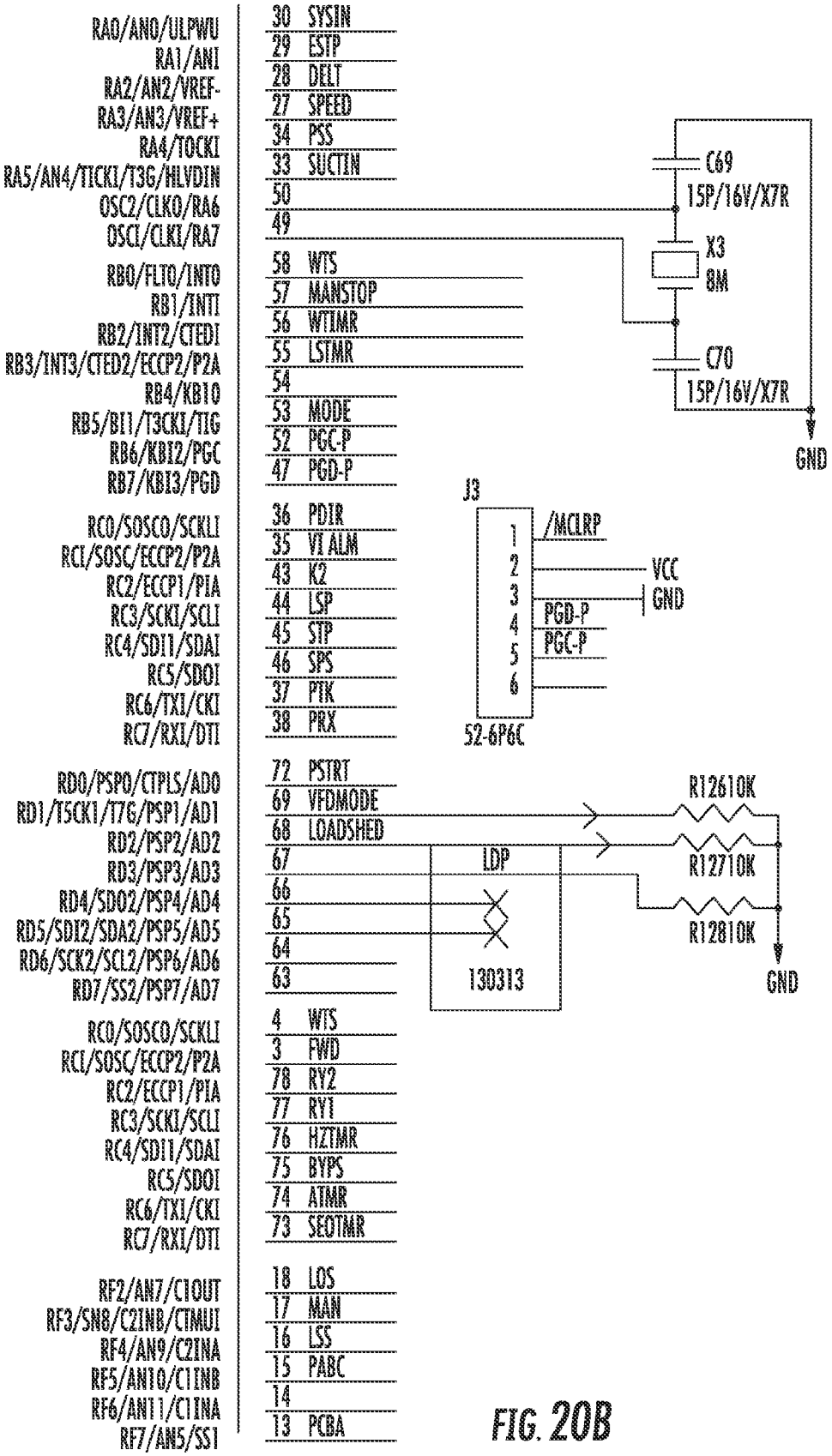
Figure 21A:
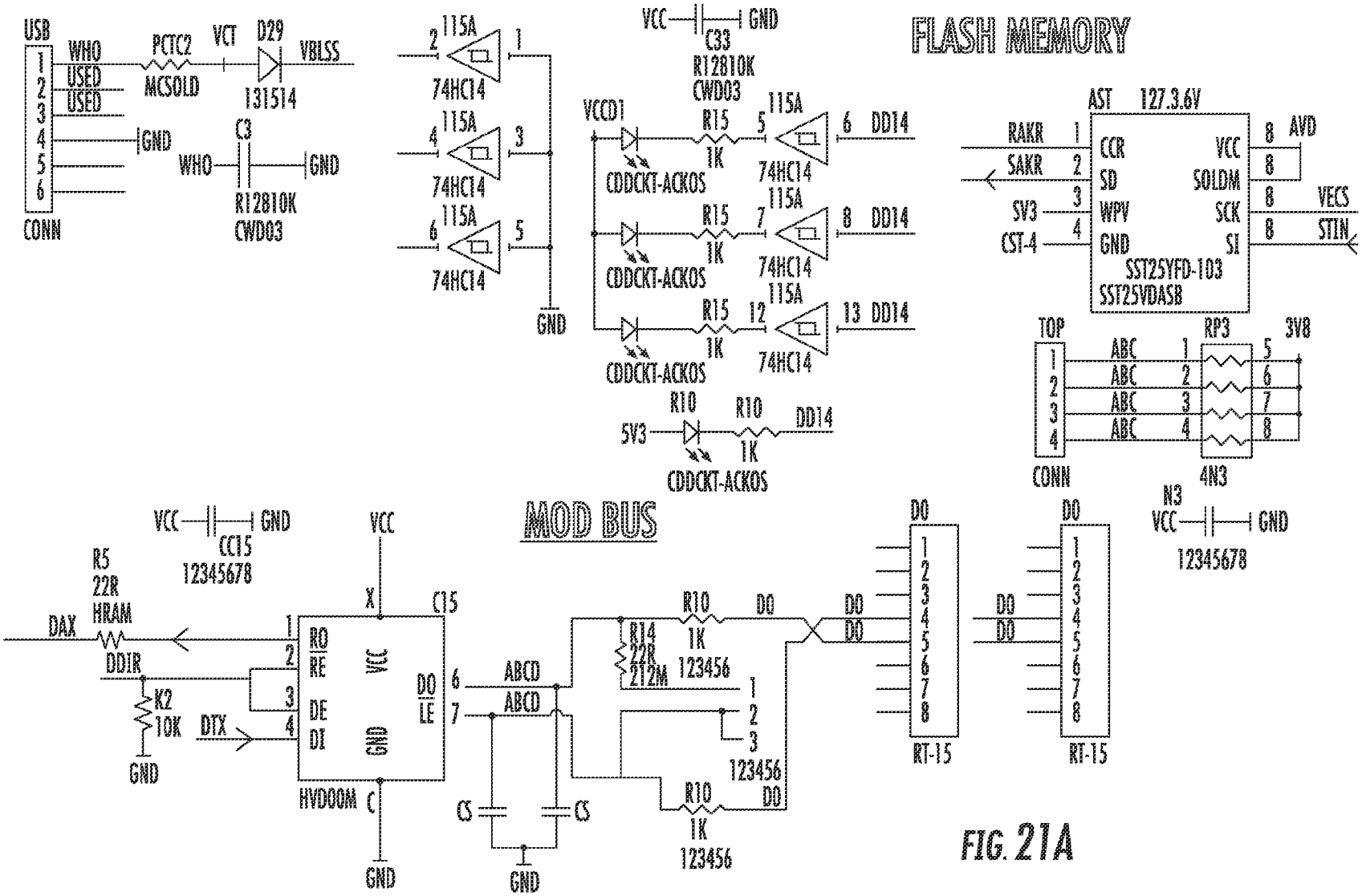
Figure 21B:
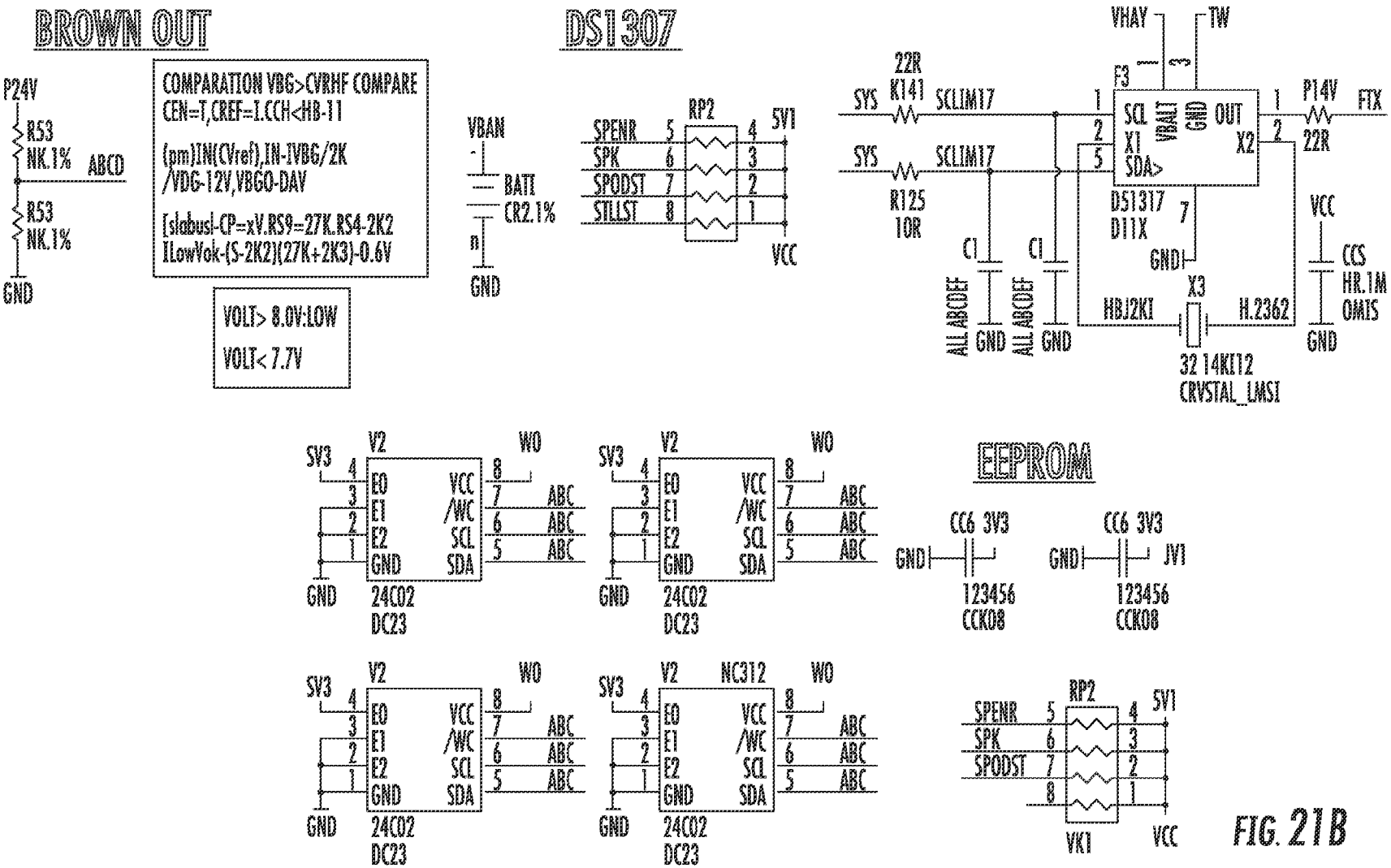
Figure 21C:
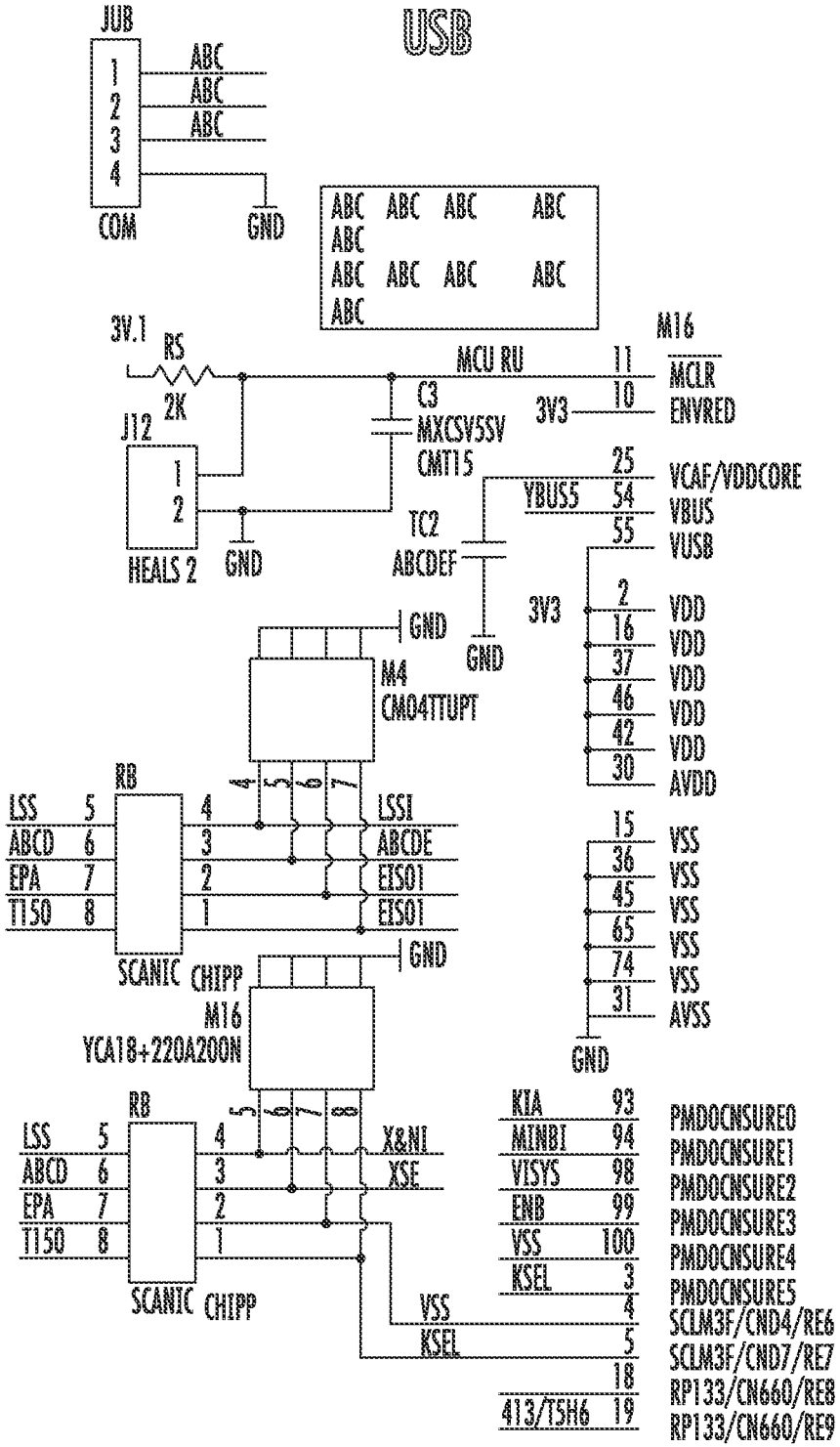
Figure 21D:
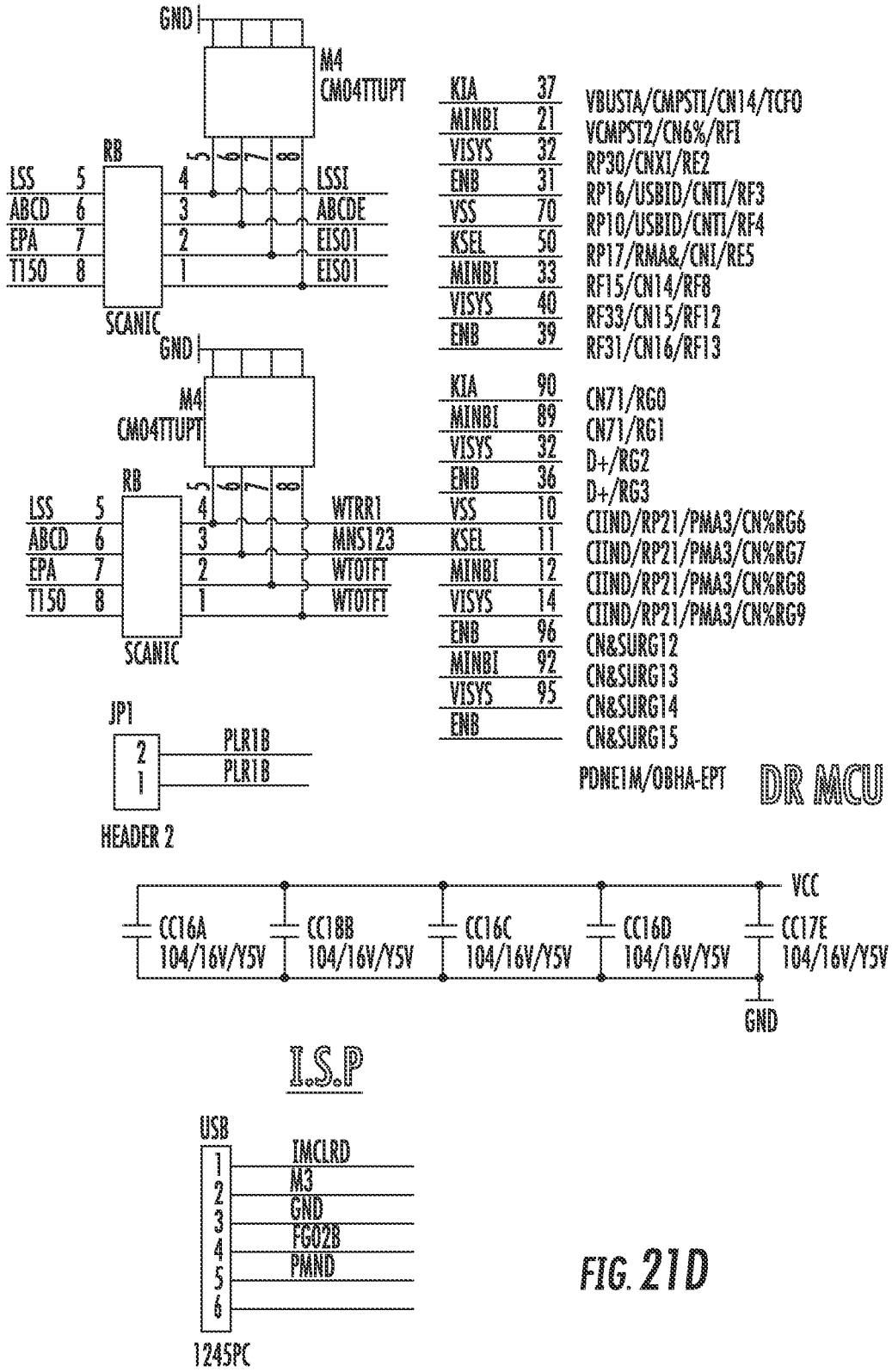
Figure 21E:
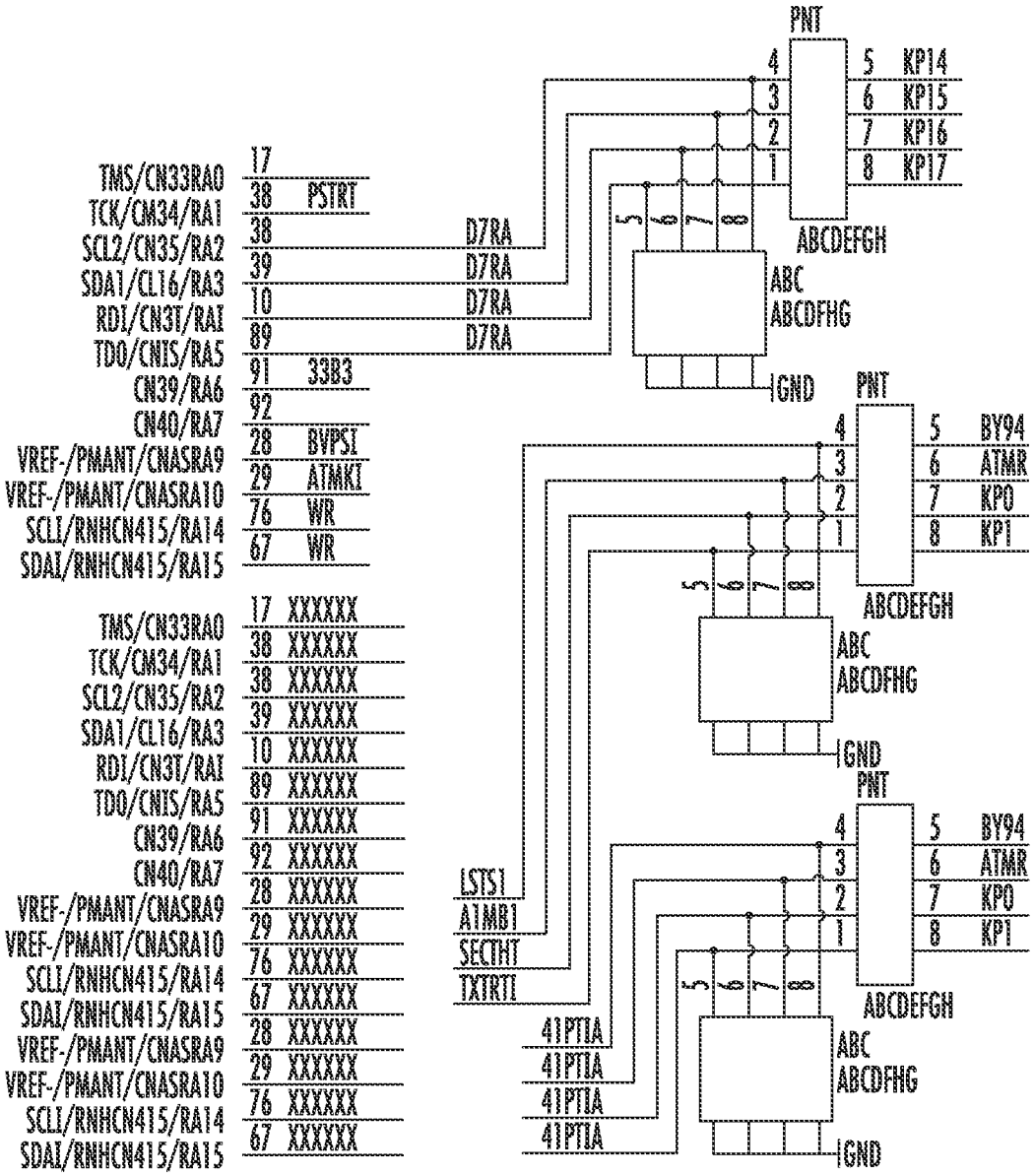
Figure 21F:
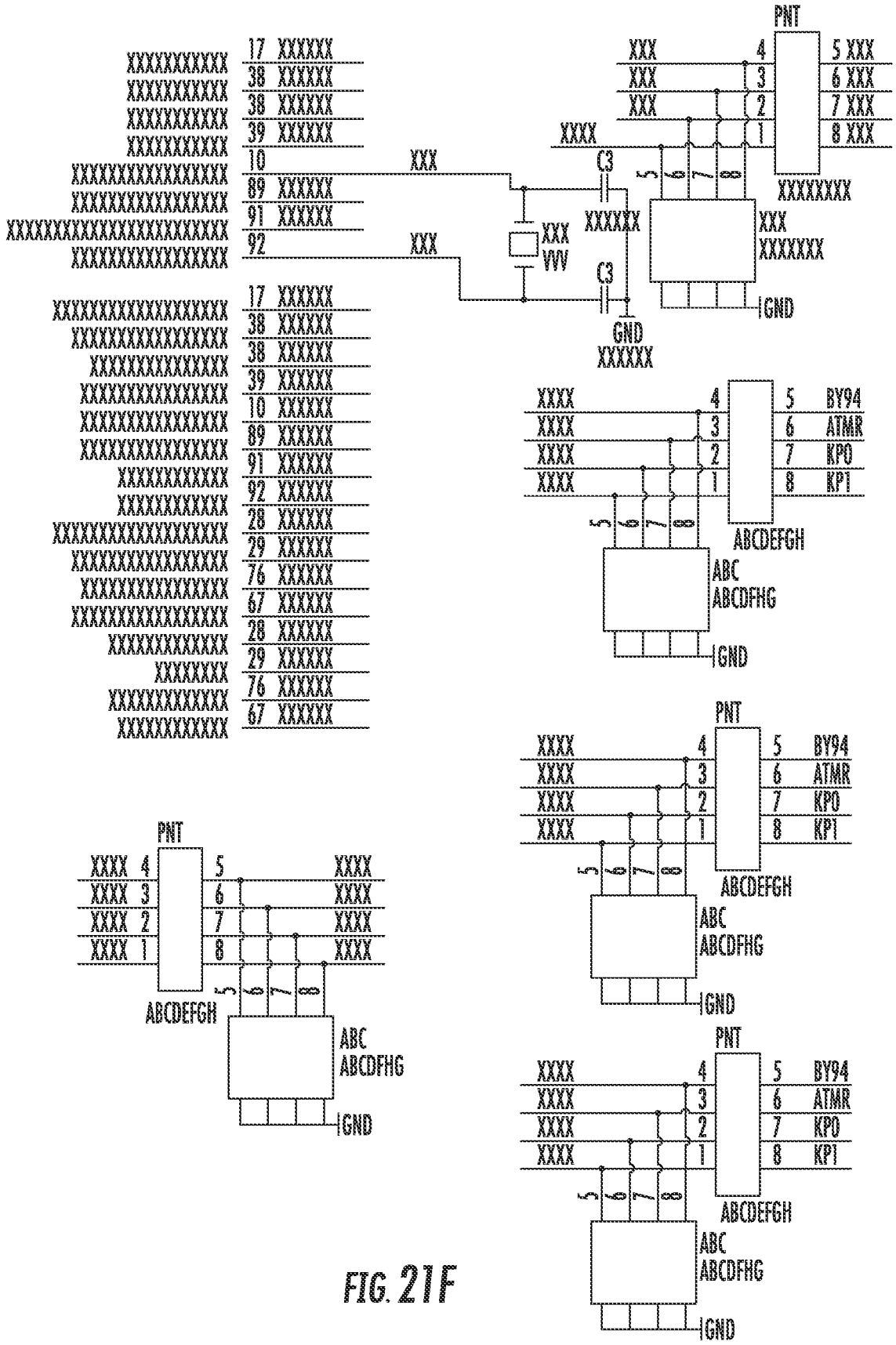
Figure 22:
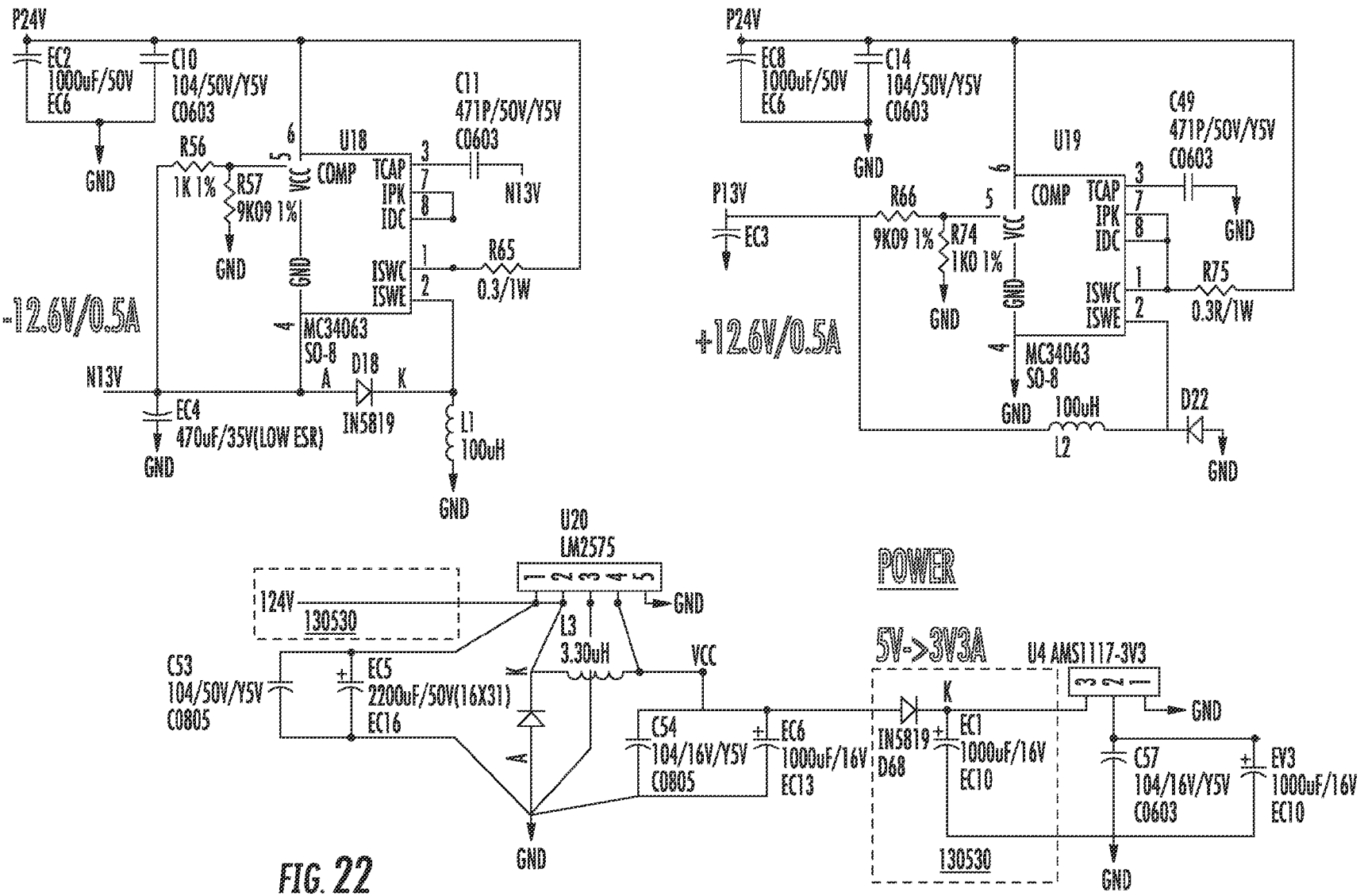

As illustrated in FIGS. 2 and 3, the controller 10 comprises a Human Machine Interface (HMI) 12 and a control board 14 (FIG. 5). The HMI 12 is used to set up and display information about the fire pump controller 10, but designed to interface the proprietary control board so the HMI 12 is not a critical device in the system 100. In other words, the HMI 12 can fail totally and the fire pump controller 10 will still operate.

As shown in FIGS. 4, 5-8 and 10-22, the controller 10 is comprised of several electrical components. A critical component in the controller 10 is the control board 14, which is designed to operate with any commercially available HMI using a Modbus interface 16. The Modbus interface 16 will not affect the operation of the fire pump controller 10 if it fails on the HMI 12 or the control board 14.

Referring to FIGS. 5-8, the control board 14 divides system functionality into three parts, which it controls using multiple Peripheral Interface Controllers or PIC 18. The control board 14 includes a Control PIC 18*a*, a Power Monitor PIC 18*b*, and a Data Recorder PIC 18*c*.

Figure 4:
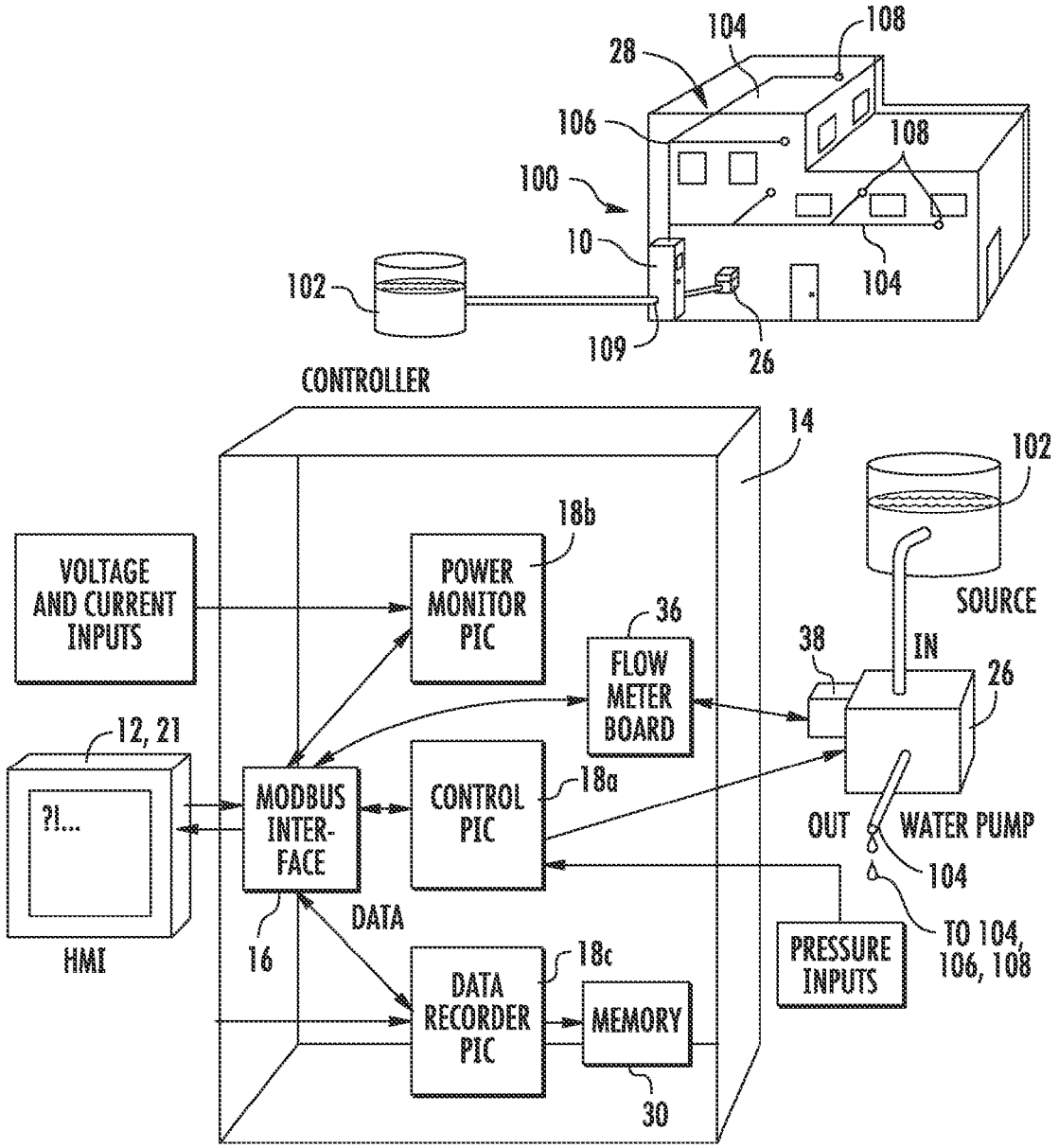
FIG. 4 is a schematic of an embodiment of a fire suppression system, including a controller, which might be used in a structure, such as a building.

The Control PIC 18*a* is the heart of the system and is protected by the Power Monitor PIC 18*b* and the Data Recorder PIC 18*c* from severe line transients caused by, for example, lightning. The Control PIC 18*a* is critical for operation of the controller 10, which is responsible for initiating, operating and shutting down the fire suppression system 100, specifically the water pump 26 and sprinkler system 28, as shown in FIG. 4. The Power Monitor PIC 18*b* is designed to receive all the voltage and current inputs, process them, and send the information to the HMI 12 for display. The voltage and current inputs are protected for normal industrial transients, but not lightning transients. So, if these lightning transients get through the input protection, the Power Monitor PIC 18*b* may be destroyed. However, because the Power Monitor PIC 18*b* is not critical to the operation of the Control PIC, destruction of the Power Monitor PIC 18*b* will not shut down the fire pump controller 10.

Further, communication between the Control PIC 18*a* and the Power Monitor PIC 18*b* is achieved via digital input and output signals and not the Modbus 16. Accordingly, the Modbus communication is not critical either. Even though destruction of the Power Monitor PIC 18*b* may stop the Modbus 16 communication between all devices, it will not shut down the fire pump controller 10.

The HMI 12 uses the Modbus 16 to query the Control PIC 18*a* and the Power Monitor PIC 18*b* for information to display, but it does not pass critical operations information from the Control PIC 18*a* to the Power Monitor PIC 18*b*. As previously noted, the HMI 12 is therefore not critical to operation of the fire pump controller 10. In fact, it can be physically removed from the controller 10 without shutting down the controller 10 or preventing it from starting.

The Data Recorder PIC 18*c* is also not critical for the operation of the fire pump controller 10. The Data Recorder PIC 18*c* merely collects data and stores it in non-volatile memory 30 for future analysis. The Data Recorder PIC 18*c* also receives input information from the same inputs as the Power Monitor PIC 18*b*, while information from the Control PIC 18*a* is sent via digital input and output signals and not by the Modbus 16. Accordingly, damaging transients may destroy the Data Recorder PIC 18*c* without shutting down the fire pump controller 10 or preventing it from starting.

As a result of this distributed functionality, the failure of non-critical inputs or outputs does not prevent the fire pump controller 10 from operating. The critical inputs of the control board 14 are designed using a double-isolation technique. The double isolation technique uses opto-isolators 32 to drive relay coils 34 (see FIG. 19). Normally, a relay is considered plenty of isolation between the outside world and the circuit board. However, experience has shown that lightning transients can be so high that a transient may "jump" through the contracts to the coil and damage the operating circuits on the control board 14. The present invention is capable of increasing the isolation by a factor in the range of two to five times. As a way of increasing the isolation and preventing such transient jumps, opto-isolators 32 are used to drive the circuits that drive the relay coils. The result is an increase in isolation from about 1000 volts to about 5000 volts.

Figure 23:
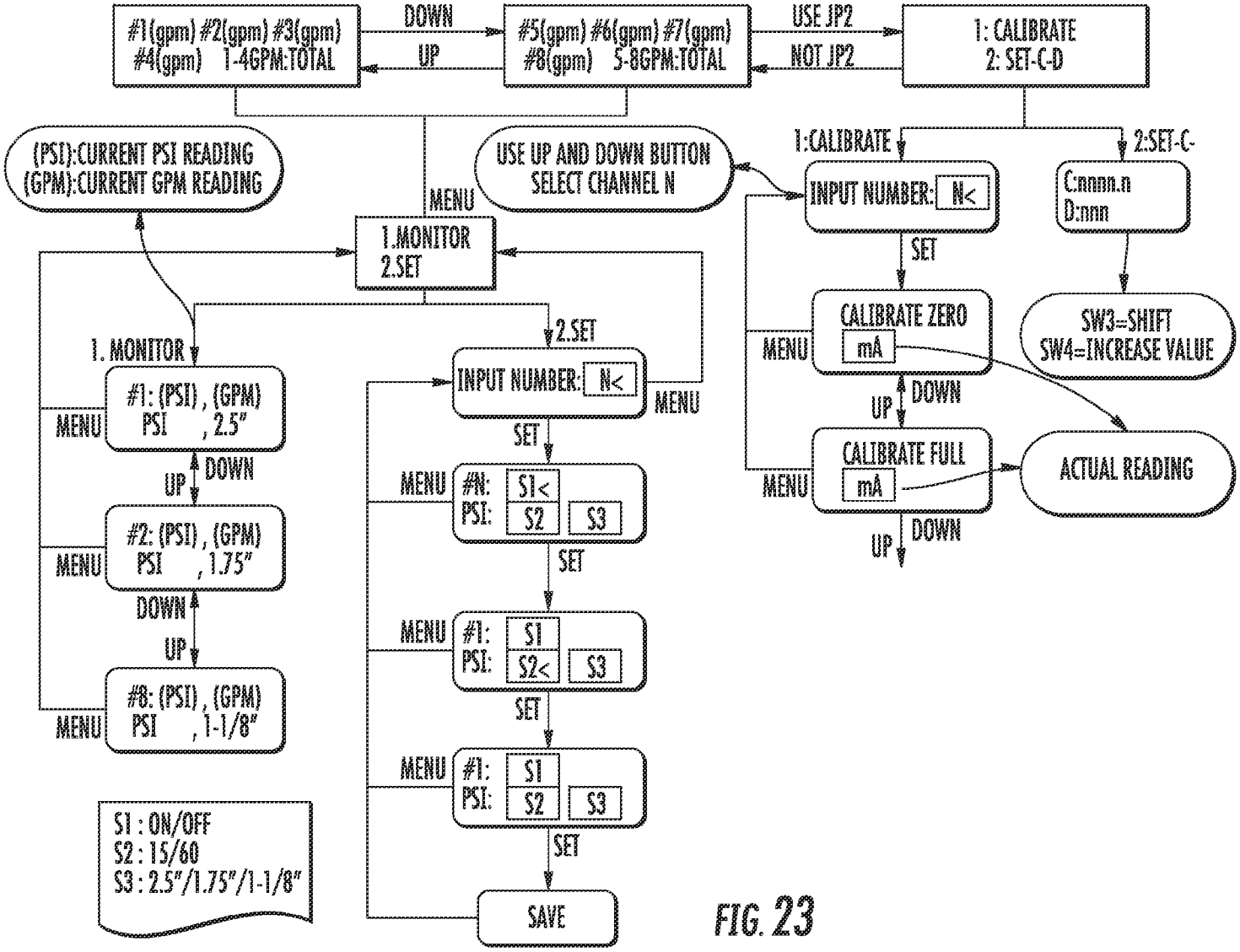
FIG. 23 is a chart illustrating exemplary operation functionality of a flow meter used with the system in accordance with the present invention.

As shown in FIG. 23, the control board 14 is also designed to interface with an auxiliary input board to read a Venturi flowmeter based on knowing either the C or D constraints of the specific flowmeter device. Normally during flow tests, the water pump performance is tested through the use of pitot tubes or flow meter gages. When conducting these tests, the pump is turned on and valves are adjusted until a specific flow is measured. Then they are adjusted again to get a new flow point to measure. This can be repeated five to seven times and can takes 30-60 minutes to adjust using this trial and error method. At typically 1000 gallons per minute, this can waste 60,000 gallons of water or more.

To substantially reduce this waste and save time, a unique flowmeter board 36 is used to constantly read the output of the flow meter 38. With constant readings being taken all the time, the operator just needs to slowly open a main valve to the full open position. While the valve is opening, the board takes continuous readings so the critical readings are invariably taken, thus eliminating the trial and error method. With the flow meter board 36 taking continuous readings, all the readings can be taken in just a few minutes.

Additionally, the control board 14 continuously reads the water flow and pressure so that a graph of "Flow vs. Pressure" of the system can be produced in seconds rather than hours of prior art devices. As mentioned, the result is a savings of tens of thousands of gallons of water during testing.

The HMI software is designed to read the flow and pressure from the control board 14 and graph the values, as noted above. Also, the display software is designed to read-out specific points on the curve as may be requested by an operator.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A fire system for a structure, the system comprising:

a water source;

a water pump coupled to the water source;

a water delivery construction, including sprinkler heads, for distributing water from the source to areas of a structure;

a controller electronically coupled to a water pump driver for controlling aspects of the water pump, the controller comprising:

a. three Programmable Interface Controller chips including:

i. a control PIC for controlling operation of the water pump;

ii. a power monitor PIC for receiving all voltage and current inputs to the controller; and iii. a data recorder PIC for collection and storage of data relevant to the system, wherein only the control PIC is critical to controller operation;

b. an electronically coupled HMI which queries the controller for information to display, wherein the HMI does not pass information between components of the controller and is capable of being damaged without stopping or preventing operation of the controller; and c. an isolation scheme for isolating the controller from incoming energy transients, such as lightning, the isolation scheme comprising a relay and opto-isolators to drive the relay and increase the isolation by a factor of at least two over the relay alone.

2. The system of claim 1, further comprising a flow meter within the water delivery construction and a flow meter reader within the controller and coupled to the flow meter, wherein the flow meter reader is capable of taking continuous readings of the flow meter.

3. The system of claim 2, wherein the readings of the flow meter reader are either displayed or downloaded by a HMI.

4. The system of claim 1, wherein the controller comprises the isolation scheme and the increase in isolation over a relay alone is greater than a factor of two.

5. The system of claim 4, wherein the increase in isolation over a relay alone is by a factor of about five.

6. The system of claim 2, wherein the flow meter reader takes continuous readings during flow testing of the system.

7. The system of claim 6, wherein the flow meter reader conserves both water and power during a flow test.

8. A fire pump controller electronically coupled to a water pump driver for a fire system, the controller comprising:

a. three isolated chips including:

i. a control PIC for controlling operation of the water pump;

ii. a power monitor PIC for receiving all voltage and current inputs to the controller; and iii. a data recorder PIC for collection and storage of data relevant to the system;

b. an electronically coupled HMI which queries the controller for information to display, wherein the HMI does not pass information between components of the controller and is capable of being damaged without stopping or preventing operation of the controller; and c. an isolation scheme for isolating the controller from incoming energy transients, such as lightning, the isolation scheme comprising a relay and opto-isolators to drive the relay and increase the isolation by a factor of at least two over the relay alone.

9. The fire pump controller of claim 8, further comprising a flow meter reader coupled to a flow meter, wherein the flow meter reader is capable of taking continuous readings of the flow meter.

10. The fire pump controller of claim 9, wherein the readings of the flow meter reader are displayed or downloaded by the HMI.

11. The fire pump controller of claim 8, wherein the HMI queries the control PIC and the power monitor PIC for information to display, but does not pass critical operation information from the control PIC to the power monitor PIC.

12. The fire pump controller of claim 8, wherein the power monitor PIC prevents power transients from damaging the control PIC.

13. The fire pump controller of claim 11, wherein the power monitor PIC prevents power transients, such as lightning, from damaging the control PIC.

14. The fire pump controller of claim 8, wherein the isolation scheme increases isolation of the controller over a relay alone by a factor of two.

15. The fire pump controller of claim 14, wherein the increase in isolation over a relay alone is by a factor of about five.

16. The fire pump controller of claim 9, wherein the flow meter reader takes continuous readings during flow testing of the system.

17. The fire pump controller of claim 16, wherein the flow meter reader conserves both power and water during a flow test.

18. The controller of claim 1, further comprising double isolation of critical inputs to the controller using opto-isolators to drive relay coils.

19. The controller of claim 1, further comprising an auxiliary input board interfaced with the controller to read Venturi flowmeters.

* * * * *